US005719302A

United States Patent [19]

Perrut et al.

[11] Patent Number: 5,719,302

[45] Date of Patent: Feb. 17, 1998

[54] PROCESSES FOR CHROMATOGRAPHIC FRACTIONATION OF FATTY ACIDS AND THEIR DERIVATIVES

[75] Inventors: Michel Perrut, Nancy; Roger-Marc Nicoud, Richardmenil, both of France; Harald Breivik, Skjelsvik, Norway

[73] Assignee: Pronova a.s, Lysaker, Norway

[21] Appl. No.: 545,615

[22] PCT Filed: Apr. 29, 1994

[86] PCT No.: PCT/NO94/00079

§ 371 Date: Jan. 18, 1996

§ 102(e) Date: Jan. 18, 1996

[87] PCT Pub. No.: WO94/25552

PCT Pub. Date: Nov. 10, 1994

[30] Foreign Application Priority Data

Apr. 29, 1993 [GB] United Kingdom ..... 9308912
Oct. 29, 1993 [GB] United Kingdom ..... 9322310

[51] Int. Cl.[6] ..... C11B 3/10

[52] U.S. Cl. ..... 554/191; 554/205

[58] Field of Search ..... 554/191, 205

[56] References Cited

U.S. PATENT DOCUMENTS

| | | | |
|---|---|---|---|
| 2,985,589 | 5/1961 | Broughton et al. | 210/34 |
| 3,696,107 | 10/1972 | Neuzil | 260/674 SA |
| 3,706,812 | 12/1972 | de Rosset et al. | 260/674 SA |
| 3,761,533 | 9/1973 | Otani et al. | 260/674 SA |
| 4,061,556 | 12/1977 | Reis et al. | 204/271 |
| 4,124,528 | 11/1978 | Modell | 252/411 R |
| 4,147,624 | 4/1979 | Modell | 210/32 |
| 5,130,449 | 7/1992 | Lagarde et al. | 554/186 |

FOREIGN PATENT DOCUMENTS

| | | |
|---|---|---|
| 328597 | 3/1976 | Austria . |
| 347551 | 1/1979 | Austria . |
| 2103302 | 4/1972 | France . |
| 2527934 | 9/1983 | France . |
| 2651148 | 3/1991 | France . |
| 2651149 | 3/1991 | France . |
| 2686028 | 7/1993 | France . |
| 2690630 | 11/1993 | France . |
| 2694208 | 2/1994 | France . |
| 2332038 | 1/1974 | Germany . |
| 163139 | 1/1990 | Norway . |
| 2221843 | 2/1990 | United Kingdom . |

OTHER PUBLICATIONS

H. Breivik, et al., "Production and Quality Control of n–3 Fatty Acids", Clinical Pharmacology, vol. 5, pp. 25–39 (1992).

M. Perrut, "Purification of Polyunsaturated Fatty Acid (EPA and DHA) Ethyl Esters by Preparative High Performance Liquid Chromatography", LC.GC International, vol. 6, No. 10, pp. 914, 916 and 920 (1988).

R.M. Nicoud, et al., "Choice and Optimization of Operating Mode In Industrial Chromatography", Proceedings of the 9th International Symposium on Preparative and Industrial Chromatography, Société Française de Chimie, pp. 205–220 (1992).

(List continued on next page.)

*Primary Examiner*—Paul F. Shaver
*Assistant Examiner*—Deborah D. Carr
*Attorney, Agent, or Firm*—Fitzpatrick, Cella, Harper & Scinto

[57] ABSTRACT

A process for recovering at least one of purified polyunsaturated fatty acids (PUFA) and polyunsaturated fatty acid mixtures from a feed composition includes a step of (i) treating the composition by either (a) stationary bed chromatography or (b) multistage countercurrent column fractionation in which a solvent is a fluid at supercritical pressure, and recovering at least one PUFA-enriched fraction. The process also includes a step of (ii) subjecting the fraction recovered in the treating step to further fractionation by simulated continuous countercurrent moving bed chromatography, and recovering at least one fraction containing the purified PUFA or the PUFA mixture.

14 Claims, 6 Drawing Sheets

OTHER PUBLICATIONS

J.M. Beebe, et al, "Preparative-Scale High-Performance Liquid Chromatography of Omega-3 Polyunsaturated Fatty Acid Esters Derived from Fish Oil", Journal of Chromatography, vol. 459, pp. 369-378 (1988).

L. Doguet, et al., "Fractionnement D'Esters Ethyliques D'Acide Gras Polyinsatures Par Chromatographie Preparative Supercritique", 2éme Colloque sur Les Fluides Supercritiques, Institut National Polytechnique de Lorraine, pp. 219-226 (1991).

G. Ganetsos, et al., eds., "Semicontinuous Countercurrent Chromatography: Simulated Moving-Column Systems", *Preparative and Production Scale* Chromatography, Marcel Dekker, Inc., pp. 233-371 (1993).

L. Szepesy, "Continuous Liquid Chromatography", Journal of Chromatography, vol. 108, pp. 285-297 (1975).

M. Perrut, "Les Fluides Supercritiques, Applications en abondance", Informations Chimie, No. 321, pp. 166-177 (1990).

H. Coenen, et al., "Anwendungen der Extraktion mit überkritischen Gasen in der Nahrungsmittel-industrie", Chem.-Ing. Tech., 55 Nr. 11, pp. 890-891 (1983).

V.K. Zosel, "Praktische Anwendungen der Stofftrennung mit überkritischen Gasen," Angew. Chem., 90 pp. 748-755 (1978).

G. Brunner, et al, "Zum Stand der Extraktion mit komprimierten Gasen", Chem.-Ing. Tech. 53, Nr. 7 pp. 529-542 (1981).

W. Eisenbach, "Supercritical Fluid Extraction: A Film Demonstration", Ber. Bunsenges. Phys. Chem., 88, pp. 882-887 (1984).

Derwent Abstract of WPI Acc. No. 94-080207/10, whose patent family member of JP 6-033088 was published Feb. 8, 1994.

Derwent Abstract of WPI Acc. No. 90-231450/30, whose patent family member ZA 8905758 was published Apr. 25, 1990.

Derwent Abstract of WPI Acc. No. 86-26738641, whose patent family member JP 61192797 was published Aug. 27, 1986.

STEP 2

STEP 1

PROCESSES FOR CHROMATOGRAPHIC FRACTIONATION OF FATTY ACIDS AND THEIR DERIVATIVES

BACKGROUND OF THE INVENTION

1. Field of the Invention

The present invention concerns processes for chromatographic fractionation of compositions comprising polyunsaturated fatty acids or derivatives thereof.

2. Description of the Related Art

Fractionation of fatty acids or their derivatives has been widely investigated in recent years. The reason for this interest lies in the recognition that some fatty acids, especially long chain polyunsaturated fatty acids, are precursors for so-called prostanoid compounds, including prostacyclins and prostaglandins, which play an important role in the regulation of biological functions such as platelet aggregation, inflammation and immunological responses.

In this specification polyunsaturated fatty acids are identified according to the system wherein the omega- or n-number denominates the position of the first double bond when counting from the terminal methyl group, e.g in an omega-3 or n-3 fatty acid, the first double bond occurs at the third carbon atom from the terminal methyl group of the acid. Further, when a fatty acid is identified, for instance, as C18:3, this refers to a fatty acid having 18 carbon atoms in the chain and three double bonds.

Two important polyunsaturated omega-3 fatty acids, EPA (eicosapentaenoic acid, C20:5) and DHA (docosahexaenoic acid, C22:6) are found in marine oils. The biological properties of these fatty acids have been discussed in many publications and patents, such as for instance GB-2221843 which teaches that concentrated mixtures of EPA and DHA are efficient products for the treatment and prophylaxis of multiple risk factors for cardio-vascular diseases.

Correspondingly, the polyunsaturated fatty acids of the omega-6 series, such as gamma-linolenic acid or arachidonic acid, may be produced from linseed oil or corn oil for nutritional and pharmaceutical uses.

In order to be active without toxicity, these. polyunsaturated compounds must exhibit an all-cis (Z—Z) conformation corresponding to how they appear in nature. Unfortunately, polyunsaturated fatty acids are extremely fragile when heated in the presence of oxygen as they are subjected to fast isomerization, peroxidation and oligomerization. Thus the fractionation and purification of these products to prepare the pure fatty acids is extremely difficult: distillation—even under vacuum—leads to non-acceptable product degradation; whereas liquid-liquid extraction or crystallization are not efficient, especially not when high purity products for nutritional or pharmaceutical uses are required.

Polyunsaturated fatty acids are to be found in natural raw materials, such as marine oils or vegetable oils. In such oils, and in concentrates of polyunsaturated fatty acids from such oils, there are many possible categories of by-products/contaminants that preferably should be removed in products intended for nutritional and pharmaceutical uses. A discussion of the major categories of such unwanted by-products/contaminants is given by H. Breivik and K. H. Dahl, Production and Quality Control of n-3 Fatty acids. In: J. C. Frolich and C. von Schacky, Klinische Pharmakologie. Clinical Pharmacology Vol. 5 Fish, Fish Oil and Human Health 1992 W. Zuckschwerdt Verlag, Munich.

Thus the fatty acids do not naturally occur in simple binary mixtures from which they can be easily isolated.

To illustrate the difficulty of achieving pure polyunsaturated fatty acids by fractionation of natural oils, Tables 1 and 2 below present the composition of some typical fatty acid ethyl ester mixtures obtained from natural sources either by a simple ethanol transesterification or with subsequent fractionation of unsaturated fatty acid chains through molecular distillation.

TABLE 1

Composition of fatty acids esters obtained from a typical linseed oil (transesterification) in mass percent

| | |
|---|---|
| C16:0 | 5.3 |
| C18:0 | 2.5 |
| C18:1 | 14.5 |
| C18:2 | 16.8 |
| C18:3 (n-3) | 60.6 (α-linolenic acid) |
| Others | 0.3 |

TABLE 2

Composition of fatty acid esters obtained from a typical fish oil (transesterification:2a and transesterification followed by molecular distillation 2b) in mass percent:

| | 2a | 2b |
|---|---|---|
| C14:0 | 8.1 | 0.3 |
| C16:0 | 17.9 | 9.1 |
| C16:1 | 6.9 | 2.8 |
| C16:4 | 1.9 | 6.0 |
| C18:0 | 2.8 | 4.2 |
| C18:1 | 11.2 | 0.1 |
| C18:2 | 1.4 | 0.6 |
| C18:3 | 0.8 | 0.3 |
| C18:4 | 3.5 | 3.5 |
| C20:1 | 2.7 | 4.5 |
| C20:4 | 2.2 | 3.7 |
| C20:5 | 15.9 | 32.8 |
| C21:5 | 0.6 | 0.9 |
| C22:1 | 2.1 | 0.1 |
| C22:5 | 2.4 | 2.7 |
| C22:6 | 13.2 | 20.9 |
| Others and unknown | 6.4 | 7.5 |

Obviously, the most interesting components of such mixtures for recovery are the fragile polyunsaturated fatty acid esters that must be obtained at the highest possible purity for dietary, pharmaceutical or cosmetic purposes.

The most common processes in use today for such fractionations and purifications are combinations of process steps, such as transesterification followed by one or several of the following process steps: fractional crystallization at low temperatures, molecular distillation to achieve separation according to chain length, urea adduct crystallization or extraction with metal salt solutions to achieve the separation of the saturated and polyunsaturated fatty acids, supercritical fluid fractionation on countercurrent columns, and stationary bed chromatography with either liquid or supercritical eluent (see the article of M. PERRUT in LC-GC, International Volume 1, No. 6, p 58 (1988) and Norwegian Patent No. 163,139). As known to those skilled in the art, the raw oil often is refined and pretreated before transesterification. However, due to the problems mentioned above, the isolation and purification of pure polyunsaturated fatty acids or their derivatives are expensive to carry out and suffer from loss of the wanted substances. There is therefore a long-felt want in the art to find an improved method for recovering purified polyunsaturated fatty acids from common sources thereof.

It has now been surprisingly found that the fractionation of complex mixtures comprising polyunsaturated fatty acids and their derivatives, such as triglycerides, esters, amides and salts, is conveniently achievable by using a simulated continuous countercurrent moving bed chromatographic system either in conjunction with certain preliminary purification procedures, and/or by using as the eluent in the system a fluid which is at a supercritical pressure.

Before discussing the principles of a simulated continuous countercurrent moving bed chromatographic system (hereafter sometimes termed a "simulated moving bed system" for brevity) it may be helpful to consider the more usual stationary bed chromatographic system.

As is well known, a conventional stationary bed chromatographic system is based on the following concept: a mixture whose components are to be separated is (normally together with an eluent, in which case the term "preparative elution chromatography" is often applied to the system) caused to percolate through a container, generally cylindrical, called the column, containing a packing of a porous material, called the stationary phase, exhibiting a high permeability to fluids. The percolation velocity of each component of the mixture depends on the physical properties of that component so that the components exit from the column successively and selectively. Thus, some of the components tend to fix strongly to the stationary phase and thus will be more delayed, whereas others tend to fix weakly and exit from the column after a short while, together with the eluent if used. Many different stationary bed chromatographic systems have been proposed and are used for both analytical and industrial production purposes. Regarding large-scale chromatographic processes, the preferred systems were cited and compared at a recent symposium (see in Proceedings of 9th Symposium on Preparative and Industrial Chromatography, NANCY April 1992, ed. M. PERRUT, ISBN 2–905267.18.6, the article of R. M. NICOUD and M. BAILLY, p. 205–220).

Large scale conventional stationary bed chromatography has been used to produce purified fractions of EPA and DHA (M. Perrut (1988) Purification of polyunsaturated fatty acids (EPA and DHA) ethyl esters by preparative high performance liquid chromatography-LC-GC 6: 914–20. JM Beebe, PR Brown and JG Turcotte (1988) Preparative scale high performance liquid chromatography of omega-3 polyunsaturated fatty acid esters derived from fish oil. J. Chromatogr.459:369–78), L. Doguet, D- Barth, M. Perrut, Fractionnement d'esters ethyligues d'acides gras polyinsaturés par chromatographie préparative supercritique, Actes du 2$^{eme}$ Colloque sur les fluides supercritiques, Paris 16/17 Octobre 1991, Ed. M. Perrut. A Method for purification of individual polyunsaturated fatty acids comprising fractionation by liquid chromatography is disclosed in Derwent, WPI, Dialog accession no 008344449, Abstract of ZA Patent no. 900425. However, due to low productivity and high dilution of the product, this technology is considered prohibitively expensive for commercial production, even when a first step of concentration of polyunsaturated fatty acids is implemented by means of an extraction process, as described in the already cited Derwent Abstract, WPI, accession no. 008344449.

In contrast, a simulated moving bed system consists of a number of individual columns containing adsorbent which are connected together in series and which are operated by periodically shifting the mixture and eluent injection points and also the separated component collection points in the system whereby the overall effect is to simulate the operation of a single column containing a moving bed of the solid adsorbent.

Thus, a simulated moving bed system consists of columns which, as in a conventional stationary bed system, contain stationary beds of solid adsorbent through which eluent is passed, but in a simulated moving bed system the operation is such as to simulate a continuous countercurrent moving bed.

The basic operating principles of the simulated moving bed chromatographic system will be further described later in this specification with reference to FIG. 1 of the accompanying drawings.

Simulated moving bed chromatography with liquid eluents has been known and used for more than 20 years, especially for separations of two very similar components and for the isolation of one component from a mixture of similar components. The potential advantages of the simulated moving bed method are considerable compared with classical stationary bed chromatographic processes:

- it is operated as a continuous rather than as a batch system;
- the dilution of raffinate and extract components in the eluent is much lower; in favourable cases, the components are recovered at the same or even greater concentration as in the feed, whereas in stationary bed processes the dilution of the fractions is frequently from 100 to 1000 which results in very high costs related to eluent handling and eluent/product separation;
- the number of theoretical plates needed for a given fractionation is much lower than that required in conventional stationary bed processes, which results in much lower costs both regarding the stationary phase and regarding the equipment that often can be worked at low or medium pressure.

Such process concepts have been used to achieve separation of simple binary mixtures, for instance, paraxylene purification or glucose/fructose separation at very high flow rates and low costs.

Processes and equipment for simulated moving bed chromatography are described in several patents, among which the following can be cited: U.S. Pat. No. 2,985,589, U.S. Pat. No. 3,696,107, U.S. Pat. No. 3,706,812, U.S. Pat. No. 3,761,533, FR-A-2103302, FR-A-2651148 and FR-A-2651149. The topic is also dealt with at length in "Preparative and Production Scale Chromatography", edited by Ganetsos and Barker, Marcel Dekker Inc, New York, 1993.

However, up until now the simulated moving bed chromatographic system has not been successfully employed in the separation and recovery of complex mixtures, in particular of purified polyunsaturated fatty acids from the mixtures in which these acids are typically found. Thus, if such a mixture is injected into a simulated moving bed system it is found that two individual polyunsaturated fatty acids (e.g. EPA and DHA) may be separated from each other. However, all the other components in the feed mixture will also be present in the two fractions, and accordingly the total concentration of the purified acid will not be very high. For example, for the separation of EPA and DHA, almost all of the fatty acids with chain length lower than C20 will normally appear in the EPA fraction, while the DHA fraction will be contaminated with fatty acids with higher chain length.

In an article "Continuous Liquid Chromatography" in Journal of Chromatography, 108 (1975), 285–297, Szepesy et al described a simulated moving bed chromatographic system and they detail an experiment in which their method was employed to separate a mixture of benzene and naphthalene in n-hexane. These authors also outline an experiment for using their equipment to accomplish the separation of $C_{16}$–$C_{22}$ saturated and unsaturated fatty acid methyl esters. Significantly, for this latter experiment, the authors modified their apparatus so that it no longer operated as a continuous countercurrent moving bed process.

For a full understanding of the present invention it is now necessary to discuss the use of supercritical fluids as eluents in chromatographic systems.

It is well known that it is possible to change from one state of a pure compound (i.e. solid, liquid or gaseous) to another state by changing the temperature and/or pressure of the compound. It is also well known that there exists a value, termed the "critical value" of temperature and/or pressure beyond which it is possible to pass from the liquid state to the gaseous state without ebullition and in the reverse direction without condensation in a continuous manner.

It is known that a fluid in supercritical state, i.e. in a state characterized either by a pressure and a temperature respectively higher than the critical pressure and temperature in the case of a pure compound, or by a representative point (pressure, temperature) located beyond the critical point envelop curve represented on a (pressure, temperature) diagram in the case of a mixture of components, exhibits a high solvent power for many substances, much higher than that observed with the same fluid in a compressed gas state. The same behaviour is observed with "subcritical" liquids, i.e. liquids in a state characterized either by a pressure higher than the critical pressure and a temperature lower than the critical temperature, in the case of a pure compound, or by a pressure higher than the critical pressure and a temperature lower than the critical temperature of the components in the case of a mixture of components (see in the journal "Informations Chimie" No. 321, October 1990, pages 166 to 177 the article of Michel PERRUT, entitled "Les Fluides Supercritiques, applications en abondance").

The important and controllable variations of the solvent power of such fluids in a supercritical state are used in many processes: extraction (solid/fluid), fractionation (liquid/fluid), analytical and preparative elution chromatography, and material treatment (ceramics, polymers, etc); chemical or biochemical reactions are also conducted in such solvents.

One of the principal advantages offered by processes using fluids at a supercritical pressure consists in the easy separation between solvent (the fluid) and the extracts and solutes, as has been described in numerous publications.

The interesting properties of such fluids have been exploited for a long time in elution chromatography, either for analytical purposes (this technique is now widely used in laboratories), or for production purposes according to the process described in FR 2527934. These fluids are also used as desorption solvents for compounds fixed on adsorbents, as described in U.S. Pat. No. 4,061,556, U.S. Pat. No. 4,124,528 and U.S. Pat. No. 4147624.

In recent patent applications (FR 9205304, FR 9209444, PCT FR 9300419), the possibility of using an eluent with variable elution power in the different zones of a simulated moving bed has been discussed, and several examples using simple binary mixtures demonstrating the superiority of such processes and equipment permitting eluent power modulation on classical processes and equipments with constant eluent power have been presented. Particularly, these applications describe the utilization of fluids at supercritical pressure—i.e. a supercritical fluid or subcritical liquid—the physico-chemicals properties of which permit easy eluent power modulation, even on industrial scale equipment. Moreover, utilization of non-toxic, non-flammable carbon dioxide as eluent avoids any hazard linked to classical organic solvents and permits final purified products free of any traces of potentially harmful organic solvent to be obtained.

Although, as just mentioned, the concept of using a fluid at supercritical pressures as eluent in a simulated moving bed chromatographic system has been applied to the separation of simple binary mixtures, it has not previously been proposed to utilize this concept to the purification of polyunsaturated fatty acids since whatever pretreatments are carried out before the final fractionation/purification step, complex mixtures of a great number of components are always to be processed as has already been illustrated above.

It has also been known for a long time that it is possible to fractionate vegetable or animal oils on countercurrent columns using supercritical fluids, especially carbon dioxide or carbon dioxide mixed with an organic solvent such as propane, hexane and alcohols (see for example Austrian patent specification Nos. 328597 and 347551, European patent specification No. 741451, German Patent No. 2332038, Coenen H., Kriegel E., Chem. Ing. Tech., 55, 1983, p. 890; Zosel K., Angew. Chem., 90, 1978, p. 748; Brunner G., Peter S., Chem. Ing. Tech. 53, 1981, p. 529; Eisenbach W., Ber. Bunsenges. Phys. Chem., 88 1984, p. 882).

However, applying this technique to the purification of complex mixtures of polyunsaturated fatty acids and their derivatives leads only to recovery of fractions of insufficient purity for many purposes.

SUMMARY OF THE INVENTION

Accordingly, in view of the state of the art it would be an advance of technical and commercial importance to be able to provide an improved process for the fractionation of compositions comprising polyunsaturated fatty acids or derivatives thereof and which could utilize the potential benefits of the simulated moving bed chromatographic system.

Surprisingly, we have now found in accordance with the present invention that employing either a conventional stationary bed chromatographic process or a supercritical fluid fractionation on multistage countercurrent column(s) to achieve a preliminary separation and purification of the compositions containing the polyunsaturated fatty acids, with a subsequent purification using a simulated moving bed system, substantially overcomes the difficulties of recovering purified polyunsaturated fatty acids utilizing the simulated moving bed technique. We have furthermore found in accordance with the present invention that a preliminary purification step can, in some instances, be omitted altogether if the purification is effected using a fluid at a supercritical pressure as the eluent in the simulated moving bed system. The invention therefore permits the development of methods for recovering purified polyunsaturated fatty acids which are superior in terms of productivity and cost to the currently practised methods.

Hereafter, the term "polyunsaturated fatty acid" (often abbreviated as PUFA) will be used to denominate both polyunsaturated fatty acids in their free acid form and also derivatives of these acids. These derivatives may be glycerides, esters, phospholipids, amides, lactones, salts or the like. PUFAs of special interest encompass the following: EPA, DHA, GLA (gamma-linolenic acid) and DGLA (dihomogamma-linolenic acid (C20:3 n-6)).

More particularly, the present invention in one aspect provides a process for recovering one or more purified PUFAs or PUFA mixtures from a feed composition comprising said PUFA or PUFAs, which process comprises the steps of:

(1) treating said composition by means either of (a) stationary bed chromatography or (b) multistage countercurrent column fractionation in which the solvent is a fluid at supercritical pressure, and recovering one or more PUFA-enriched fractions, and (2) subjecting said PUFA-enriched fraction or fractions recovered in step (1) to further fractionation by means of simulated continuous countercurrent moving bed chromatography and recovering one or more fractions containing purified PUFA or PUFA mixture.

In accordance with a further aspect the present invention provides a process for recovering one or more purified PUFAs or PUFA mixtures from a feed composition comprising said PUFA or PUFAs, which process comprises the step of subjecting said composition to fractionation by means of simulated continuous countercurrent moving bed chromatography in which there is used as the eluent a fluid at a supercritical pressure, and recovering one or more fractions containing purified PUFA or PUFA mixture.

By means of this latter process according to the present invention, it becomes feasible to modulate the eluent power in the different zones of the simulated moving bed system, in a conventional operation, so that the purification may be more readily controlled to yield products of desired compositions.

In certain preferred embodiments of the present invention, the expedient of using fluid at supercritical pressure as the eluent in the simulated moving bed system is employed in conjunction with a preliminary purification of the PUFA composition using either stationary bed chromatography or multistage countercurrent column fractionation in which the eluent or solvent is a fluid at supercritical pressure. Thus, in these preferred cases the process of the invention comprises the steps of:

(1) treating a composition comprising one or more PUFAs by means either of (a) stationary bed chromatography or (b) multistage countercurrent column fractionation, in which the eluent or solvent is a fluid at super-critical pressure, and recovering one or more PUFA-enriched fractions, and (2) subjecting said PUFA-enriched fraction or fractions recovered in step (1) to further fractionation by means of simulated continuous countercurrent moving bed chromatography in which there is used as the eluent a fluid at a supercritical pressure, and recovering one or more fractions containing purified PUFA or PUFA mixture.

As will be demonstrated in the Examples given later in this specification, it is possible by means of the process of the invention to recover desired polyunsaturated fatty acids in highly pure state from complex mixtures containing the desired components. In preferred cases, the purity is greater than 60%, more preferably at least 90%.

As already mentioned, the process according to one aspect of the invention is characterized by an initial fractionation step consisting either of a stationary bed chromatographic fractionation or of a supercritical fluid fractionation on multistage countercurrent columns, whereby a selective fractionation of the feed mixture is achieved, followed by a subsequent simulated continuous countercurrent moving bed chromatographic step.

In the case of carrying out the initial fractionation using a stationary bed chromatogrpahic system there may be used either a conventional liquid eluent or fluid at super-critical pressure as the eluent.

Alternatively, the initial purification step involves fractionation on one or possibly more e.g. two, multistage countercurrent columns, using as solvent fluid which is at supercritical pressure.

Examples of materials which can be used, above their supercritical pressures, as eluents or solvents in the initial fractionation step of the present invention include carbon dioxide, nitrous oxide, halohydrocarbons (e.g. halogenated methane, ethane, propane) and lower ($C_1$–$C_6$) alkanes. Of these, carbon dioxide is preferred for use in the invention for several reasons: its critical temperature is close to ambient which permits low temperature processing of thermolabile molecules; it is non-toxic and non-flammable; and it is widely available at high purity at low cost. As known to those skilled in the art, it is often advantageous to include an organic co-solvent in the supercritical fluid or subcritical liquid. Suitable co-solvents include methanol, ethanol, acetone, hexane and various esters such as ethyl acetate.

It can be mentioned here that attempts to purify complex PUFA-containing mixtures by the use alone of supercritical fluid fractionation on one or more multistage countercurrent columns do not result in satisfactory recovery of highly purified products, even if a significant internal or external reflux of purified fraction is applied on the heads of such columns. On the contrary it has been established that extremely low productivity is attained if highly purified fractions are required. On the other hand, the use of this technique as a first step fractionation does permit the elimination of most impurities (heavy and light fractions) from PUFA mixtures, whereby there are obtained partially purified fractions particularly suitable for the second stge fractionation employing the simulated moving bed system.

In the initial fractionation step some of the fractions having a high content of unwanted byproducts may be separated and rejected, and in the subsequent step fractions having a higher content of the PUFA components to be separated and isolated are introduced into the simulated moving bed chromatographic system for further purification and separation.

The fractions may be introduced into the simulated moving bed system either combined at one injection point or, often advantageously, separately at different injection points. Thus, we often have observed unexpected benefits when the fractions from the initial separation are injected at different positions into the simulated moving bed system, as will be illustrated in Examples 1a and 1b below which demonstrate that, in the experiment described, separate injection of the fractions enables a better production economy, than the use of a single injection point. Thus, is often preferred to inject each fraction separately.

In the case that a supercritical fluid is used as the eluent in the simulated moving bed chromatographic separation step (whether this step is used by itself or follows an initial fractionation stage), there may be used as the supercritical fluid those compounds or mixtures of compounds already mentioned above as being suitable for use as supercritical fluid eluents in the first fractionation step. Again, carbon dioxide is the preferred eluent, optionally with an organic co-solvent.

The unwanted components or impurities which are found in common source mixtures of polyunsaturated fatty acids or their derivatives will generally belong to one or other of the following three categories:

(1) Compounds naturally occurring in natural oils, such as marine oils or vegetable oils. All components normally present in the marine organism or the plant or seed from which the oil is extracted, may to a greater or lesser degree be present in the concentrates which are starting materials for further purification. These components may in addition to other fatty acids include sterols, mainly cholesterol, vitamins, and environmental pollutants such as polychlorobiphenyl (PCB), polyaromatic hydrocarbon (PAH) pesticides, dioxines and heavy metals. The process according to the present invention is especially suitable to remove such contaminants or unwanted components. For instance, PCB, PAH, dioxines and chlorinated pesticides are all highly non-polar components and may as such be separated from the more polar polyunsaturated fatty acids or their derivatives in the initial fractionation step.

(2) Byproducts formed during storage, refining and previous concentration steps will include isomers and oxidation or decomposition products from the polyunsaturated fatty acids or their derivatives. For instance, auto-oxidation of fatty acids or their derivatives may result in potentially harmful polymeric materials. Such components may be removed through the process of the present invention, most suitably during the initial step.

(3) Contaminants from solvents or reagents which are utilized during previous concentration or purification steps. An example of this may be urea which often will be added to remove saturated or mono-unsaturated fatty acids from the polyunsaturated fatty acids. The removal of these components is most easily achieved during the initial step of the process of the invention.

Typically, the most interesting components of natural oils which are desired to be recovered are the fragile PUFAs, which must be obtained at the highest possible purity for dietary, pharmaceutical or cosmetic purposes. By means of a conventional stationary bed chromatography process, for instance using 30 cm diameter HPLC columns packed with reverse phase octadecyl silica gel (approx. 25 μm average diameter) and various eluents (acetonitrile/water or methanol/water), we have been able to obtain purities over 98% (α-linolenic acid esters from linseed oil), over 95% (EPA) and over 90% (DHA) from ethyl esters of marine oil that has been preconcentrated by molecular distillation and urea fractionation in order to contain approx. 50% EPA and approx. 30% DHA. However, such fractionations lead to very high dilution of the pure products in eluent mixture (more than 500), which requires large scale evaporation/distillation equipment, resulting in very high purification costs, very often higher than 1000 US $ per kg of pure product, even for large scale production (tonnes per year).

Suitable PUFA-containing feed compositions for fractionating by the process of the invention may be obtained from natural sources (including vegetable and animal oils and fats) through various classical steps, such as glyceride transesterification or glyceride hydrolysis followed in certain cases by selective processes such as crystallisation, molecular distillation, urea fractionation, extraction with silver nitrate or other metal salt solutions, iodolactonisation or supercritical fluid fractionation. In certain embodiments of the process of the present invention, the resulting feed mixtures are then subjected to fractionation and purification to recover desired PUFAs or PUFA mixtures on equipment combining either a conventional stationary bed chromatography column or one or more columns equipped for multistage supercritical fluid fractionation, with a simulated continuous countercurrent chromatography device. The equipment is operated so as to combine a first step leading to the recovery of several fractions, and a second step in which some only of the fractions recovered in the first step are subjected to simulated moving bed chromatographic fractionation.

The advantages of this combination of steps arise in part from the fact that the first step can be operated in conditions where the uninteresting components are rejected whereas the interesting components are obtained in form of mixtures, said conditions leading to much higher productivity and to much lower dilution of the recovered fractions than when, for instance, a stationary bed system is employed to recover highly pure, single polyunsaturated fatty acids. Thus, the cost of carrying out the initial fractionation in the process of the present invention is much lower than for a conventional operation of a stationary bed chromatographic system for highly selective fractionation. The initial fractionation also has the advantage of eliminating most of the unwanted components from the feed mixture. The resulting fractions that are applied to the simulated moving bed system can be considered as binary or ternary mixtures which contain only very small amounts of other components but are enriched in one of the interesting fatty acids. The second stage of fractionation, using the simulated continuous countercurrent moving bed system, can achieve a very efficient recovery of the desired PUFA component or components, whereby the overall process can be operated to recover highly pure PUFA components from complex mixtures in a most efficient and economical manner. As already mentioned in order to best utilize these advantages of the second step fractionation, the recovered fractions are not remixed prior to treatment in the simulated countercurrent chromatography step but instead are injected separately at various different positions into the system.

The preferred process according to this invention can generally be described as a process for the fractionation of compositions comprising polyunsaturated fatty acids or derivatives thereof to recover p components of highly purified polyunsaturated fatty acids, characterized by a combination of the following steps:

1a) an elution chromatography step using a stationary bed column in which the eluent is preferably a fluid at supercritical pressure and wherein the feed mixture is fractionated into n fractions, and q of the n fractions are introduced into the second step, whereas (n−q) fractions are discarded, after recovery of eluent and/or recycled and/or are returned to the feed mixture of the first step for further fractionation; or 1b) a supercritical fluid fractionation step using, preferably, two or more multistage countercurrent columns packed with conventional packings (e.g. Raschig, Pall, Intralox, etc) and operated either with an internal reflux, caused by a temperature gradient along each column, or with an external reflux, caused by an auxiliary pump re-injecting part of the extracts exiting dissolved in the fluid at the head of each column, wherein the feed mixture is fractionated into n fractions (preferably 4 fractions), and q of these n fractions (preferably 2 fractions) are introduced into the second step, whereas (n−q) fractions (preferably 2 fractions) are discarded after recovery of the solvent, and/or recycled and/or returned to the feed mixture of the first step for further fractionation; and 2) a simulated continuous countercurrent chromatography step in which the eluent is preferably a fluid at supercritical pressure and wherein q of the fractions recovered in step 1(a) or 1(b) are injected at r points into the simulated countercurrent chromatographic system, said system being operated so as to collect m fractions, wherein r is equal to or smaller than q and m is greater than or equal to p, and the remainder of the fractions (m−p), if any, optionally are returned to the first or second step for further processing or are discarded.

The feed mixture may be a composition of animal or vegetable origin comprising polyunsaturated fatty acids or derivatives thereof. In particular, the feed mixtures may be naturally occurring oils such as fish oils, or more concentrated forms of such natural oils obtained according to techniques well-known in the art.

Further the feed mixture may be a composition consisting of fatty acids or derivatives thereof as well as other groups of compounds originating from the raw material, especially environmental pollutants.

It is an especially preferred embodiment of the invention to use as feed mixture marine oils to prepare EPA and/or DHA, or derivatives thereof in high purity.

BRIEF DESCRIPTION OF THE DRAWINGS

The invention will now be further described with reference to the accompanying drawings, in which.

DESCRIPTION OF THE PREFERRED EMBODIMENTS

Figure 1:
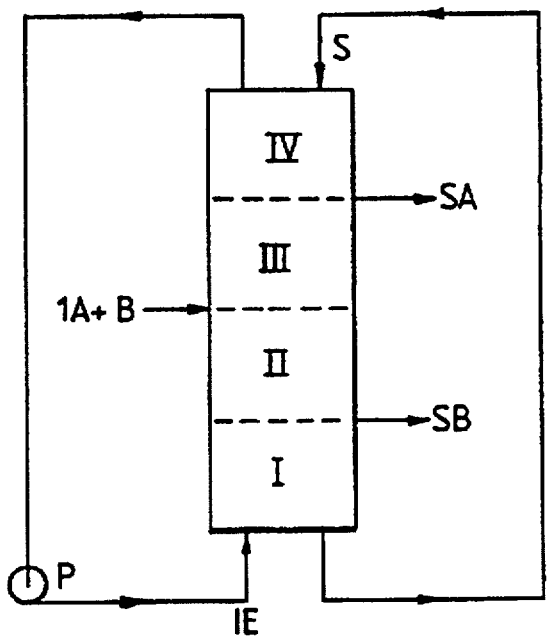
FIG. 1 schematically illustrates the principles of a simulated continuous countercurrent chromatography system.

Referring to FIG. 1, the concept of a simulated continuous countercurrent, chromatographic process is explained by considering a vertical chromatographic column containing stationary phase S divided into sections, more precisely into four superimposed zones I, II, III and IV going from the bottom to the top of the column. The eluent is introduced at the bottom at IE by means of a pump P, whereas the mixture of the components A and B which are to be separated is introduced at IA+B between zone II and zone III. An extract containing mainly B is collected at SB between zone I and zone II, and a raffinate containing mainly A is collected at SA between zone III and zone IV. In FIG. 1, the eluent flows upwards. As described in detail below, a simulated downward movement of the stationary phase S is caused by movement of the introduction and collection points relative to the solid phase. It will be readily appreciated that from a practical point of view, it is much better not to move the stationary phase relatively to the introduction and collection points, but rather to maintain this stationary phase motionless and to move the introduction and collection points by shifting them periodically from one zone to another in the sense of the eluent circulation, that is upwardly in the case of FIG. 1. Referring to FIG. 1, eluent flows upward and mixture A+B is injected between zone II and zone III and the components will move according to their chromatographic interactions with the stationary phase, for example adsorption on a porous medium: the component B that exhibits the stronger affinity to the stationary phase will be more slowly entrained by the eluent and will follow it with delay, whereas the component A that exhibits the weaker affinity to the stationary phase will be easily entrained by the eluent. If the right set of parameters, especially the flow rate in each zone, are correctly estimated and controlled, the component A exhibiting the weaker affinity to the stationary phase will be collected between zone III and IV and the component B exhibiting the stronger affinity to the stationary phase will be collected between zone I and zone II.

The moving bed system schematically illustrated in FIG. 1 is limited to binary fractionation, but in the practice of the present invention one would generally operate the simulated moving bed fractionation step to obtain two or more fractions. The operating principles then involved are well known to those skilled in the art; they are illustrated below with reference to FIG. 2.

Figure 2:
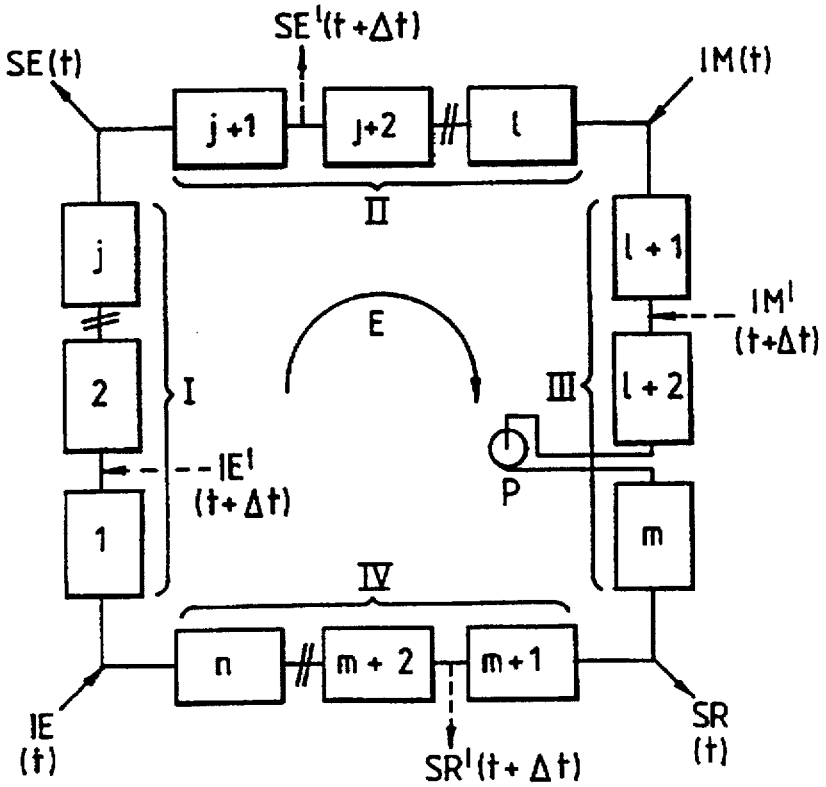
FIG. 2 schematically illustrates the practical operation of a simulated continuous countercurrent chromatography system.

In practice, the simulated continuous countercurrent moving bed process is usually performed using equipment comprising a certain number n (usually from 4 to 24) of chromatography columns packed with a porous medium forming the stationary phase. Such an arrangement is schematically illustrated in FIG. 2. As shown, the n chromatography columns (Ck) are connected in series and are percolated by liquid eluent E, the circulation of which is being caused by pump P in the direction of the arrow at a strictly controlled, constant flow rate, the pump being arbitrarily set between two columns. The mixture to be fractionated and eluent make-up are introduced at IM and IE respectively, between certain columns (Ck) and (Ck+1), so that the columns appear split into four zones. If the eluent pump flow rate and the introduction and collection flow rates are well chosen, and if the four introduction/collection points are shifted at a regular time period Dt from their location between columns (Ck) and (Ck+1) to a new location between columns (Ck+1) and (Ck+2), it is possible to fractionate the mixture into two fractions called raffinate and extract with a high selectivity, assuming of course a good choice of stationary phase and solvent.

In FIG. 2, IE', SE', IM' and SR' correspond to the positions IE, SE, IM and SR, respectively, after the shift corresponding to the period Dt.

It is to be noted that when a conventional liquid is used as eluent then the position of pump P is fixed between two columns; as liquids are non-compressible fluids, their eluent power is independent of pressure and remains constant in all the zones whatever the relative position of pump P. Further the number of columns in the different zones may vary.

In more complex versions of this basic concept, it is possible to inject more than one mixture and/or to collect more than two fractions at certain points located between two columns (Ck) and (Ck+1), these points, as those for introduction of eluent make-up and mixture to be fractionated, being shifted at regular periods of time as described above.

However, in the following, the description will be limited for simplification to the case where (referring to the hereinabove described preferred embodiment of the invention) p and q are both equal to 2, i.e. corresponding to a mixture to be fractionated into two fractions, which leads to a circuit of z eluent injection points, z composition injection points (total of 2z injection points), z extract collection points, and z raffinate collection points (total of 2z collection points). For a further simplification, let us consider the case where z equals 1, which leads to a circuit comprising successively and in series an eluent injection point, an extract collection point, a composition injection point and a raffinate collection point.

Between two successive introduction or collection points, it is possible to put one or several columns or column sections. In the following, it will be considered, for ease of understanding, that all columns are separate columns, connected in series and being of similar design and dimensions. Obviously, it is also possible to consider each zone as being defined by a section of a column rather than being defined by a separate column, which, at the limit, can lead to using a unique column with an eluent loop between its two ends. In fact, it facilitates the stationary phase packing and withdrawal procedures to use a plurality of columns, optionally divided into sections.

Referring again to FIG. 1, it would often be preferable to operate under the following conditions:

In zone I, a strong elution must be favoured, i.e. a strong elution power, in order to avoid the stronger affinity component B moving downward to the column bottom during the relative packing displacement, and so permit its collection between zone I and zone II;

In zone II, the weaker-affinity component A must be entrained by the eluent in order not to move downwards with B, whereas component B must remain fixed on the stationary phase in order to move downwards and to be collected between zone I and zone II after the relative packing displacement; this requires a lower elution power than in zone I;

In zone III, the weaker-affinity component A must move upwards with the eluent in order to be collected between zone III and zone IV whereas component B must remain fixed on the stationary phase and move downward to zone II at the relative packing displacement; this requires an elution power lower or equal to elution power in zone II;

In zone IV, the weaker-affinity component A must not be entrained by the eluent, which requires an elution power lower than in zone III.

It can be considered, as a simplification, that the eluent power must be decreased, or at least remain constant, but must not be increased, when flowing from one zone to the following, except of course when flowing from zone IV to zone I for eluent recycle.

In accordance with one aspect of the present invention, it is found that the use of a fluidat supercritical pressure in the simulated moving bed chromatographic separation step permits the eluent power to be readily modulated so that it conforms more closely to the ideal requirements in each zone.

Moreover, variants can be favourably used as described particularly in said Fr 9209444 application where the most downward zone can be suppressed; moreover, more than two fractions can be obtained from the process.

We refer now to FIG. 3, which illustrates the principle of operating a simulated continuous countercurrent moving bed process using supercritical fluid as eluent and with modulation of the elution power within the different zones of the system.

FIG. 3 is somewhat similar to FIG. 1, and like FIG. 1 is both schematic and simplified, but it illustrates the concept of a simulated moving bed and how the present invention may be put into effect, i.e. using a supercritical fluid as eluent, and with the number of zones in the chromatographic system varying from three (FIG. 3*a*), to four (FIGS. 3*b* and 3*c*), to five (FIG. 3*d*) depending on the fractionation to be performed.

Figure 3A:
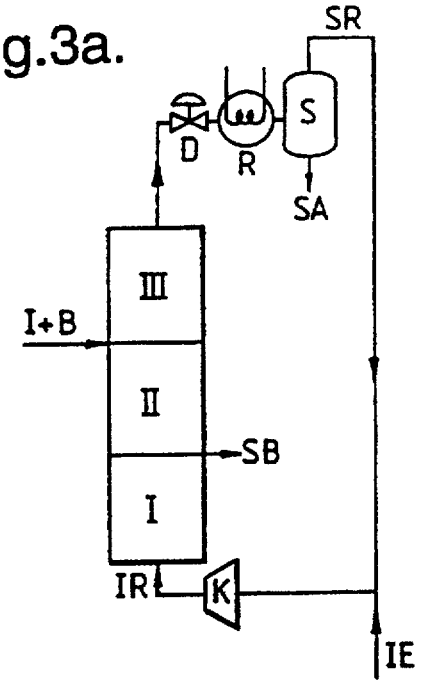
FIG. 3 schematically illustrates ways in which a simulated continuous countercurrent chromatographic system may be operated in accordance with one aspect of the invention using fluid at supercritical pressure as eluent and with modulation of the eluent power within different zones of the system.

For binary mixtures fractionations, a simple implementation with only three zones is preferable with recovery of the less adsorbed compounds from the solvent by decompression prior to solvent recycle; this decompression being achieved for example as indicated in FIG. 3*a* through valve D followed by a heat exchanger R for enthalpy supply and separator vessel S.

Figure 3B:
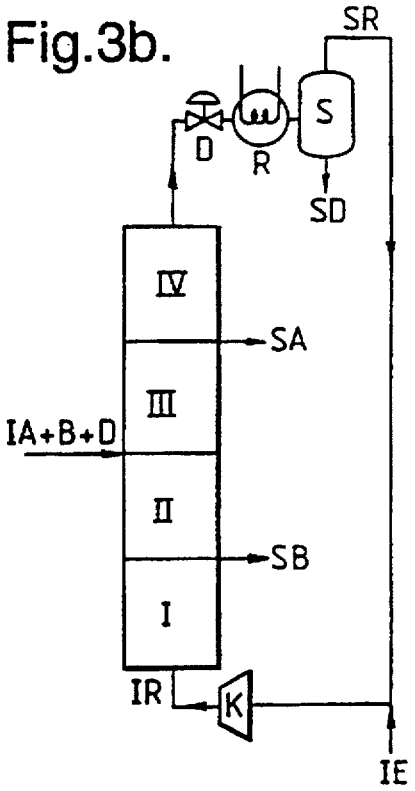
Figure 3C:
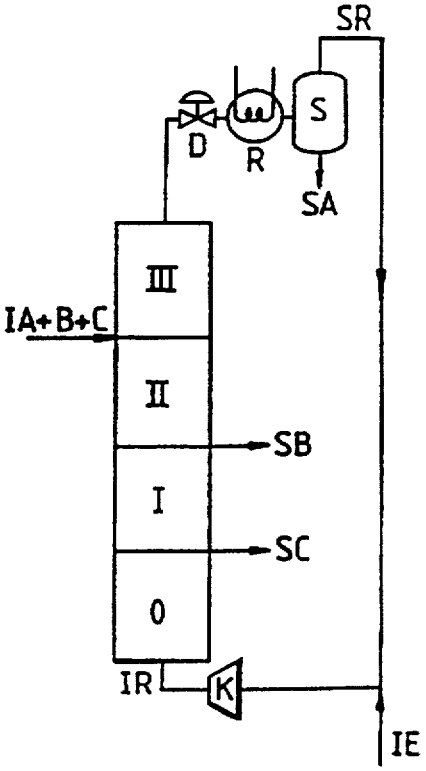

For ternary mixtures fractionations, two implementations with four zones or with five zones can be used: in the case illustrated in FIG. 3*b*, the less adsorbed compounds are entrained by the eluent from zone II, after which they are separated from the eluent by decompression prior to eluent recycle; this implementation is to be preferred when a binary mixture (A,B) of the main products is contaminated by light components (D) that exhibit a low affinity with the stationary phase and are easily entrained by the eluent from which they are easily separated as in the preceding case (FIG. 3*a*); on the other hand, in the case illustrated in FIG. 3*c*, the most adsorbed compounds (C) are stripped from zone O by high eluent power meanwhile fractionation of compounds B and A can be optimized with eluent in lower eluent power zones where a high selectivity can be reached.

Figure 3D:
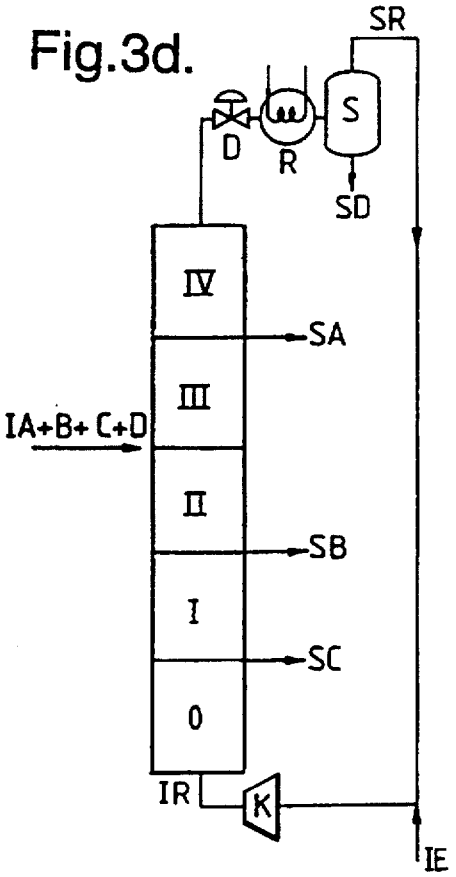

For more complex mixtures, especially those consisting of two main components A and B contaminated both by light and heavy compounds, the implementation represented in FIG. 3*d* is preferable: the heavier contaminants (C) are stripped from the stationary phase by a high eluent power fluid, A and B fractionation being operated in more selective conditions with an optimized eluent power fluid in zones I, II, III and IV, meanwhile the light or contaminants (D) are entrained by the eluent at the exit of zone IV and separated from the eluent by decompression prior to eluent recycle as described in the preceding cases (FIG. 3*d* for example).

It is clear that such equipment and process are perfectly adapted to fractionation of mixtures of fatty acids or their derivatives, either in the final step of purification in order to obtain very highly purified compounds from pre-purified feeds or at an intermediate step of purification in order to obtain purified compounds from complex mixtures such as those cited in Tables 1 and 2 above.

As these fatty acids or their derivatives are non polar compounds, carbon dioxide at a supercritical pressure (over 7.38 MPa) is an excellent eluent, as its eluent power can be well modulated regarding said solutes vis-a-vis the classical stationary phases consisting either in silica gels or reverse phase (alkyl bonded) silica gels, as is illustrated in the examples cited herebelow. Moreover, carbon dioxide is not toxic as are most organic solvents, which is an important advantage in the production of food or pharmaceutical products.

Figure 4:
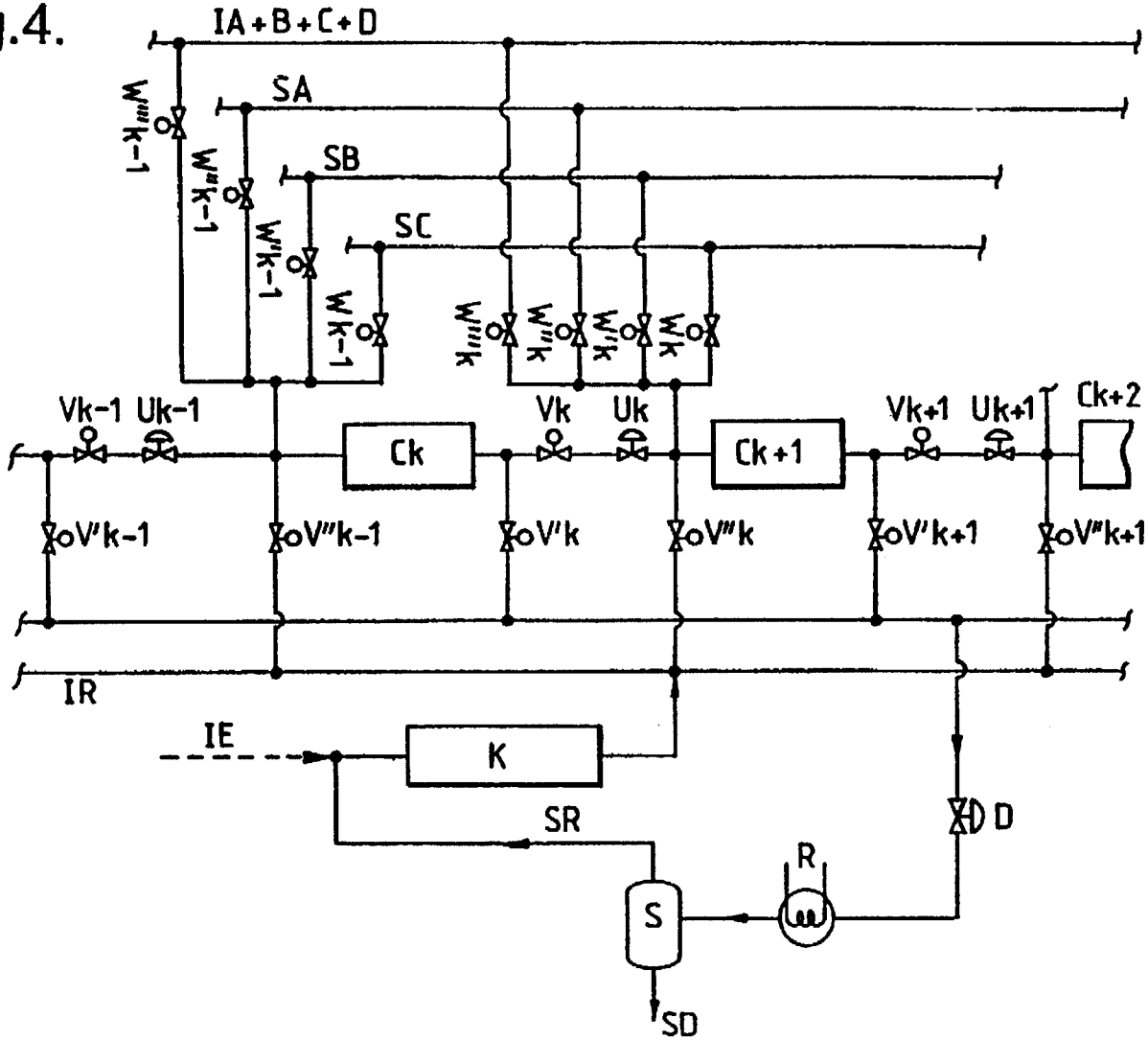
FIG. 4 schematically illustrates the practical operation of a simulated continuous countercurrent chromatography system using fluid at supercritical pressure as eluent.

FIG. 4 illustrates in greater detail how a continuous simulated moving bed chromatographic system can be operated using a supercritical fluid as eluent. The illustrated system is designed to fractionate a complex mixture into four fractions.

The equipment is composed of n chromatography columns, n being favourably chosen between 5 and 25, connected in series with one feed injection (IA+B+C+D), four fraction collection points (SA, SB, SC, SD) among which one is located on a separation vessel (S). Eluent decompression is operated through valve D which is connected to a heat exchanger R (heating or cooling according to the circumstances but most often heating in order to supply the enthalpy necessary for avoiding liquid eluent to appear and mist formation) and via S connected in series to an eluent make-up IE and a compressor or pump K (as schematically shown in FIGS. 3*d* and 4).

In order to operate pressure modulation between the different chromatographic zones, injection of feed and eluent make-up, fraction collection between the zones, the following complex array of valves, shown in FIG. 4, can be used:

Between two consecutive columns ($C_k$–$C_{k+1}$) one stop valve ($V_k$) and one regulation valve ($U_k$);

Column ($C_k$) outlet also connected to decompression step (valve D, heat exchanger R and separation vessel S) through a stop valve ($V'_k$);

Column ($C_k$) inlet also connected to eluent injection line IR through stop valve ($V''_{k-1}$), to injection line IA+B+C+D through stop valve ($W'''_{k-1}$) and to fraction collection lines SA, SB and SC through stop valves ($W''_{k+1}$), ($W'_{k+1}$) and ($W_{k+1}$) respectively.

It is easy to operate such valves in order to implement a process in accordance with this invention:

Supposing zone 0 begins at column ($C_j$):

valves ($W_{j-1}$) ($W'_{j-1}$) ($W''_{j-1}$), ($W'''_{j-1}$) are closed valve ($V_{j-1}$) is closed and ($V'_{j-1}$) is open so that the fluid effluent of column ($C_{j-1}$) is directed to decompression step, for SD collection and recycle SR valve ($V''_{k-1}$) is open to feed eluent IR.

Supposing zone I begins at column $C_j$:

valves ($W'_{j-1}$), ($W''_{j-1}$), ($W'''_{j-1}$) are closed and ($W_{j-1}$) is open to collect fraction SC valves ($V_{j-1}$) and ($V_j$) are open, valve ($U_{j-1}$) is controlled according to pressure modulation decided by the operator (full open if no pressure decrease is expected) between zones 0 and I valves ($V''_{j-1}$) and ($V'_j$) are closed.

Supposing zone II begins at column ($C_L$):

Same positions of most valves as before but for collection of fraction SB with valves ($W_{L-1}$), ($W''_{L-1}$), ($W'''_{L-1}$) closed and ($W'_{L-1}$) open.

Supposing zone III begins at column ($C_m$):

Same positions of most valves as before but for feed injection IA+B+C+D with ($W'''_{m-1}$) open and ($W_{m-1}$) ($W'_{m-1}$), ($W''_{m-1}$) closed.

Supposing zone IV begins at column ($C_p$):

Same positions of most valves as before but for collection of fraction SA with valves ($W''_{p-1}$) open and valves ($W_{p-1}$) ($W'_{p-1}$) and ($W'''_{p-1}$) closed.

There will now be described with reference to FIG. 5, a purification process in accordance with this invention in which a first stage fractionation using a stationary bed chromatographic system utilizing a conventional eluent is followed by a second stage fractionation using a simulated continuous countercurrent chromatographic system, again operated with a conventional eluent.

Figure 5B:
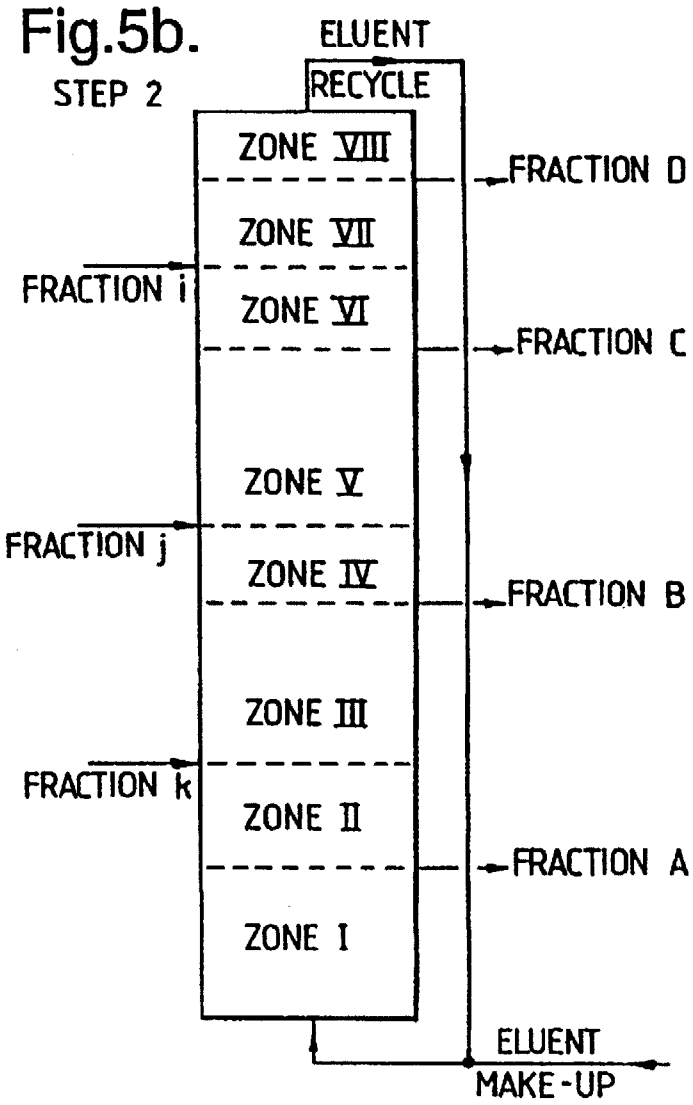
FIG. 5 schematically illustrates a two-stage purification process in accordance with an aspect of this invention in which the first stage fractionation is accomplished using a stationary bed system employing a conventional solvent as eluent and the second stage fractionation is accomplished using a simulated continuous countercurrent system, again using a conventional eluent i.e. not fluid at supercritical pressure.
Figure 5A:
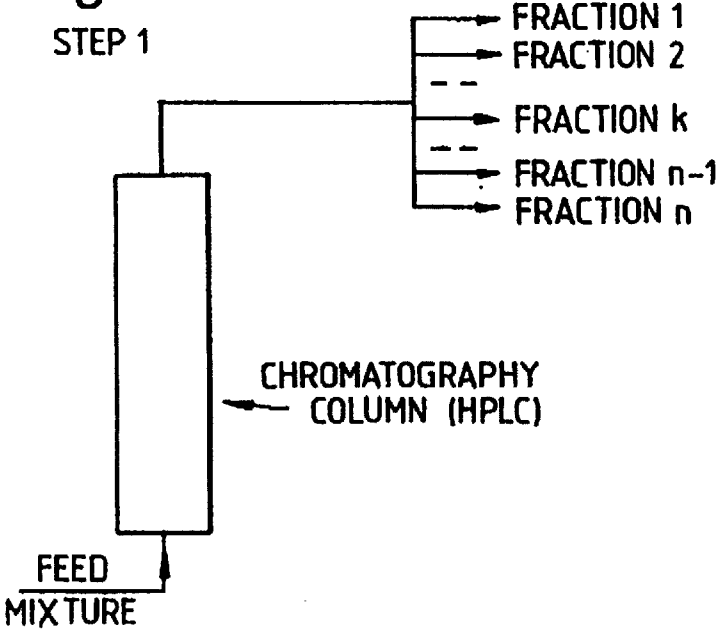

Referring first to FIG. 5*a*, there is shown schematically a stationary bed chromatographic column for conducting the initial fractionation of the feed mixture (step 1). This initial fractionation leads to n fractions (favourably 4 or 5), q of said fractions being further processed in the second fractionation step and (n–q) fractions being subjected to evaporation for eluent recycle, the products being sent to disposal or for low-value applications. The q fractions which are taken on into the second step have enhanced concentrations of the interesting components p, p being generally lower than or equal to q. Referring now to FIG. 5*b*, the q fractions are injected in step 2 at q points, into the simulated continuous countercurrent chromatography equipment which is operated so that m fractions are collected, m being generally higher than or equal to p. Of those m fractions p fractions consist of highly purified p components. It is to be noticed that FIG. 5*b* presents the case where q equals 3 and m equals 4, these numbers being chosen for ease of understanding but are not to be considered as limitation of the present invention.

The fluid percolating through the column may either be a fluid mixture, the components of which are to be separated, or a mixture dissolved in a solvent fluid called the eluent.

The eluents usable for both the simulated continuous countercurrent chromatographic step and the initial stationary bed chromatographic process can be conventional solvents or mixtures of solvents as known to a person skilled in the art. The solvents are usually chosen from the group comprising short-chain alcohols, such as methanol, ethanol, methoxyethanol or the like; short-chain ethers, such as diethylether, diisopropylether, MTBE or the like; esters such as methylacetate or ethylacetate; ketones such as acetone, methylethylketone, MIBK or the like; nitriles such as acetonitrile; or water. Mixtures of such solvents may also be used.

Similarly, conventional stationary phases for the stationary bed columns and likewise for the column(s) of the simulated countercurrent chromatographic system, as known to a person skilled in the art, can be used in the process in accordance with this aspect of the present invention. Examples of such commonly used materials are alumina; polymeric beads, preferably polystyrene reticulated with DVB (divinylbenzene); and silica gel, preferably reverse phase bonded silica gel with alkanes of C8 or C18, especially C18. The shape of the stationary phase material may be, for example, spherical or non-spherical beads of 5–200 microns, preferably 10–20 microns. Most preferred are monodisperse spherical beads of about 10 microns.

For any given separation, the eluent and/or the stationary phase are preferably the same in both the stationary bed and the simulated moving bed chromatographic steps of the process, but they may be different, as will be understood by those skilled in chromatography.

It is an especially preferred embodiment of this aspect of the present process to use a stationary phase consisting of C18 bonded silica gel and an eluent chosen from the group consisting of short chain alcohols, ethers, esters or ketones or mixtures thereof, or mixtures with water.

Normally the chromatographic process will be conducted at room temperatures, but there may be separations which are better conducted at elevated temperatures.

Figure 7:
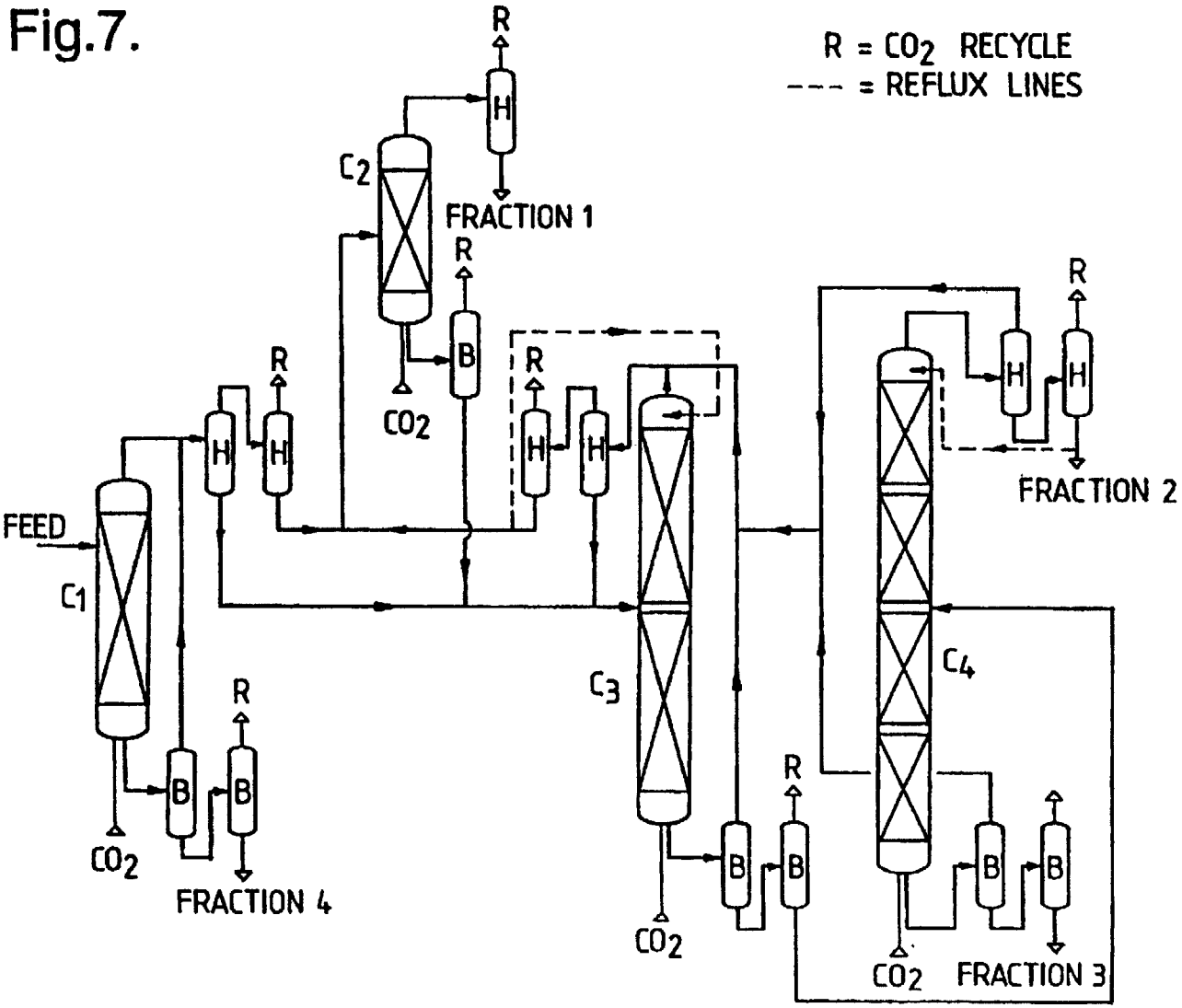
FIG. 7 schematically illustrates the operation of a first stage fractionation by means of a supercritical fluid fractionation on multistage countercurrent columns.

Reference is now made to FIG. 7 which illustrates, schematically, one preferred manner in which an initial purification step by means of a supercritical fluid fractionation on multistage countercurrent columns can be carried out, to be followed, in accordance with this invention, by a second purification step by means of a simulated moving bed chromatographic system not shown in FIG. 7.

Thus, referring to FIG. 7, the system shown is adapted to fractionate the impure starting mixture into four main fractions.

In a first countercurrent column (C1), supercritical $CO_2$ dissolves the main part of the feed, leaving only heavy components that are eliminated after $CO_2$ release (fraction 4).

Most of the extract fraction is recovered after $CO_2$ release in a separator H and sent to a countercurrent column (C3), the lighter part of such extract fraction being sent to a second countercurrent column (C2). The column (C3) is used to strip most light fractions from the mixture sent in this contactor, the heads being sent to column (C2) for recovery of the less $CO_2$-soluble components that are recycled to (C3) and elimination of the lighter fraction (fraction 1); the bottoms of (C3) are freed of $CO_2$ in the separators (H) and then sent to the final fractionation step consisting in a highly selective countercurrent column (Ch) leading two main fractions (2 and 3); the selectivity of column (C4) is increased by use of either an internal reflux caused by a thermal gradient along the column jacket or an external reflux caused by a pump re-injecting part of fraction 2 at the column head.

The invention is further illustrated by the Examples which follow.

EXAMPLE 1a

This example illustrates the purification of a mixture of fatty acid ester obtained from linseed oil, in order to recover pure esters of alpha-linolenic acid (C18:3 n-3) and linoleic acid (C18:2 n-6). The method used involves a first stage purification by means of chromatographic fractionation on a stationary bed followed by a second stage chromatographic fractionation using a simulated continuous countercurrent moving bed.

Linseed oil is subjected to transesterification with ethanol by a conventional method and leads to a mixture of ethyl esters the composition of which is presented in Table 3 below.

TABLE 3

| Composition of fatty acids esters obtained from a typical linseed oil (transesterification) in weight percent | |
|---|---|
| C16:0 | 5.2 |
| C16:1 | 0.1 |
| C18:0 | 2.5 |
| C18:1 | 14.5 |
| C18:2 | 16.8 |
| C18:3 (n-3) | 60.6 (α-linolenic acid) |
| C20:0 | 0.3 |

First step: Stationary bed chromatography with reverse phase octadecyl silica gel (12–45 μm) as stationary phase with acetonitrile as eluent, at room temperature.

Axial compression column (30 cm diameter, 30 cm stationary phase packing length) is percolated by 300 l/h of eluent; 0.84 kg of feed mixture is injected every 12 min. For each cycle of 12 min., the following fractions are collected:

Fraction 1: 4.2 1 containing 20 g/l of fatty acid esters (C18:3=52.5%–C16:0=47.5%)

Fraction 2: 3.72 1 containing 57 g/l of 99% pure C18:3

Fraction 3: 8.5 1 containing 32.9 g/l of fatty acid esters (C18:2=13.3%–C18:3=86.7%)

Fraction 4: 7.03 1 containing 11.75 g/l of fatty acid esters (C18:2=77%–C18:3=23%)

Fraction 5: 35.7 1 containing 5.16 g/l of fatty acid esters (C18:2=21.7%–C18:1=66.4%–C18:0=11.8%)

Fractions 3 and 4 were collected for use in the second fractionation step. Fractions 1 and 5 were discarded, while fraction 2 was collected without further purification.

Second step: Simulated continuous countercurrent chromatography on same stationary phase and with same eluent as in step one; 12 columns (20 cm diameter, 10 cm long) are connected in series and in a closed loop (the loop is divided into 5 successive zones I to V of two columns) with two mixture injection points, one eluent make-up point, and two collection points.

The operating flow rates and recovery were as follows:

| | |
|---|---|
| Shift period: | 4.7 min |
| Eluent recycle flow rate: | 380 l/h |
| Eluent make-up (between zones V and I) | 99 l/h |
| Fraction 4 injection (between zones II and III) | 35 l/h |
| Fraction 3 injection (between zones III and IV) | 42.5 l/h |
| Fraction A collection (between zones I and II) Containing 5 g/l of purified C18:2 (C18:2 = 98%, C18:3 = 2.0%) | 100 l/h |
| Fraction B collection (between zones IV and V Containing 17.2 g/l of purified C18:3 (C18:2 = 0.6%, C18:3 = 99.4%) | 76 l/h |

EXAMPLE 1b

The following results were obtained with the same first step fractionation (HPLC) as in Example 1a followed by a 4-zone simulated moving bed fractionation, with fractions 3 and 4 from the first fractionation being mixed and fed at one point only into the simulated moving bed system.

The operating details were as follows:

| | |
|---|---|
| Eluent recycle | 419 l/h |
| Eluent make-up (between zone IV and I) | 109 l/h |
| Feed flow rate 35 + 42.5 | 77.5 l/h |
| Fraction B collection (between zone I and II) Containing 4.6 g/l of purified C18:2 (C18:2 = 98%; C18:3 = 2%) | 109 l/h |
| Fraction A collection (between zone III and IV) Containing 16.85 g/l of purified C18:3 (C18:2 = 0.6%; C18:3 = 99.4%) | 77.5 l/h |

The eluent consumption was 10% greater for the 4-zone SMB used in Example 1b as compared to the 5-zone SMM of the same size used in Example 1a. This illustrates that the procedure with two injection points in the second stage (Example 1a) leads to less dilution than when using only one injection point (Example 1b).

EXAMPLE 2

This example illustrates the purification of a mixture of fatty acid ester obtained from fish oil, in order to recover purified EPA and DHA, again using a stationary bed fractionation followed by a simulated moving bed fractionation.

Fish oil is subjected to transesterification with ethanol by a conventional method and'leads to a mixture of ethyl esters the composition of which is presented in Table 4 below in weight percent.

First step: Stationary bed chromatography using reverse phase octadecyl silica gel (12–45 μm) with methanol/water (90-10) as eluent at room temperature.

Axial compression column (30 cm diameter, 30 cm stationary phase parking length) is percolated by 200 l/h of eluent; 0.085 kg of feed mixture is injected every 19 min. and fractions are collected.

Fraction 1: 27 1 containing 1.83 g/l of fatty acid esters

Fraction 2 13 1 containing 1.21 g/l of fatty acid esters

Fraction 3: 11 1 containing 1.3 g/l of fatty acid esters

Fraction 4: 12 1 containing 0.46 g/l of fatty acid esters

The compositions of these fractions are also given in Table 4, in weight percent.

TABLE 4

| | FEED | F1 | F2 | F3 | F4 |
|---|---|---|---|---|---|
| C14:0 | 8.1 | 13.9 | 0.0 | 0.0 | 0.0 |
| C16:0 | 17.9 | 30.8 | 0.0 | 0.0 | 0.0 |
| C16:1 | 6.9 | 11.9 | 0.0 | 0.0 | 0.0 |
| C16:4 | 1.9 | 3.3 | 0.0 | 0.0 | 0.0 |
| C18:0 | 2.8 | 4.8 | 0.0 | 0.0 | 0.0 |
| C18:1 | 11.2 | 18.9 | 1.2 | 0.0 | 0.0 |
| C18:2 | 1.4 | 2.2 | 0.5 | 0.0 | 0.0 |
| C18:3 | 0.8 | 1.1 | 0.9 | 0.0 | 0.0 |
| C18:4 | 3.5 | 4.9 | 3.3 | 0.0 | 0.0 |
| C20:1 | 2.7 | 3.8 | 2.1 | 0.4 | 0.0 |
| C20:4 | 2.2 | 1.9 | 5.3 | 0.6 | 0.0 |
| C20:5 | 15.9 | 2.2 | 51.5 | 30.3 | 0.0 |
| C21:5 | 0.6 | 0.0 | 1.6 | 1.8 | 0.0 |
| C22:1 | 2.1 | 0.0 | 4.0 | 7.5 | 1.6 |
| C22:5 | 2.4 | 0.0 | 4.5 | 8.6 | 1.8 |
| C22:6 | 13.2 | 0.0 | 24.9 | 47.1 | 10.1 |
| Various | 6.4 | 0.3 | 0.2 | 3.8 | 86.5 |

Fractions 1 and 4 are rejected. Fractions 2 and 3 are subjected to the second step fractionation.

Second step: Simulated continuous countercurrent moving bed chromatography using same stationary phase and same eluent as step one; 12 columns (30 cm diameter, 10 cm long) are connected in series and in a closed loop (the loop is divided into 5 successive zones I to V of two columns) with two mixture injection points, one eluent make-up point, and two collection points.

The operating flow rates and recovery were as follows:

| | |
|---|---|
| Shift period: | 3.3 min |
| Eluent recycle flow rate | 565 l/h |
| Eluent make-up (between zones V and I) | 80 l/h |
| Fraction 3 injection (between zones II and III) | 35 l/h |
| Fraction 2 injection (between zones III and IV) | 41 l/h |
| Fraction B collection (between zones I and II) Containing 0.55 g/l of purified DHA (C18:4 = 2.1%; C20:5 = 2.2%; C21:5 = 2.1%; C22:1 = 12.2%; C22:5 = 12.9%; C22:6 = 66%; others = 2.5%) | 83 l/h |
| Fraction A collection (between zones IV and V) Containing 0.65 g/l of purified EPA (C18:4 = 1.9%; C20:1 = 2.0%; C20:4 = 6.1%; C20:5 = 80.25% C22:5 = 0.9%; C22:6 = 6.9%; others = 2.0%) | 73 l/h |

EXAMPLE 3

This example illustrates the purification of a mixture of fatty acid ester obtained from fish oil, to recover purified EPA and DHA, again using a stationary bed fractionation followed by simulated moving bed fractionation.

Fish oil is subjected to transesterification with ethanol by a conventional method and leads to a mixture of ethyl esters the composition of which is presented in Table 4 above. Then, the mixture is subjected to molecular distillation and a mixture of the composition presented in Table 5 below is obtained.

TABLE 5

| Composition in mass percent of fatty acid esters obtained from fish oil after a transesterification process followed by molecular distillation process: | |
|---|---|
| C14:0 | 0.3 |
| C16:0 | 9.1 |
| C16:1 | 2.8 |
| C16:4 | 6.0 |
| C18:0 | 4.2 |
| C18:1 | 0.1 |
| C18:2 | 0.6 |
| C18:3 | 0.3 |
| C18:4 | 3.5 |
| C20:1 | 4.5 |
| C20:4 | 3.7 |
| C20:5 | 32.8 |
| C21:5 | 0.9 |
| C22:1 | 0.1 |
| C22:5 | 2.7 |
| C22:6 | 20.9 |
| Other components | 7.5 |

First step: Reverse phase octadecyl silica gel (12–45 μm) with methanol/water (90-10) as eluent at room temperature.

Axial compression column (30 cm diameter, 30 cm stationary phase parking length) is percolated by 200 l/h of eluent; 0.136 kg of feed mixture are injected every 19 min and fractions are collected.

Fraction 1: 27 l containing 1.71 g/l of fatty acid esters
Fraction 2: 13 l containing 3.29 g/l of fatty acid esters
Fraction 3: 11 l containing 3.15 g/l of fatty acid esters
Fraction 4: 12 l containing 0.954 g/l of fatty acid esters The compositions of the fractions are given in Table 6.

TABLE 6

| | FEED | F1 | F2 | F3 | F4 |
|---|---|---|---|---|---|
| C14:0 | 0.3 | 0.9 | 0.0 | 0.0 | 0.0 |
| C16:0 | 9.1 | 26.9 | 0.0 | 0.0 | 0.0 |
| C16:0 | 2.8 | 8.3 | 0.0 | 0.0 | 0.0 |
| C16:4 | 6.0 | 17.7 | 0.0 | 0.0 | 0.0 |
| C18:0 | 4.2 | 12.4 | 0.0 | 0.0 | 0.0 |
| C18:1 | 0.1 | 0.3 | 0.0 | 0.0 | 0.0 |
| C18:2 | 0.6 | 1.6 | 0.1 | 0.0 | 0.0 |
| C18:3 | 0.3 | 0.7 | 0.2 | 0.0 | 0.0 |
| C18:4 | 3.5 | 7.6 | 3.0 | 0.0 | 0.0 |
| C20:1 | 4.5 | 10.0 | 3.0 | 1.0 | 0.0 |
| C20:4 | 3.7 | 5.9 | 4.6 | 1.0 | 0.0 |
| C20:5 | 32.8 | 7.6 | 61.1 | 40.2 | 0.0 |
| C21:5 | 0.9 | 0.0 | 1.4 | 1.8 | 0.0 |
| C22:1 | 0.1 | 0.0 | 0.1 | 0.2 | 0.1 |
| C22:5 | 2.7 | 0.0 | 3.0 | 6.4 | 1.6 |
| C22:6 | 20.9 | 0.0 | 23.3 | 49.2 | 12.4 |
| Various | 7.5 | 0.3 | 0.1 | 0.3 | 85.9 |

Fractions 1 and 4 are rejected, and fractions 2 and 3 are subjected to the second step.

Second step: Simulated continuous countercurrent moving bed chromatography using same stationary phase and same eluent as in step one; 12 columns (30 cm diameter, 10 cm long) are connected in series and in a closed loop (the loop is divided into 5 successive zones I to V of two columns) with two mixture injection points, one eluent make-up point, and two collection points.

The operating flow rates and recovery were as follows:

| | |
|---|---|
| Shift period: | 2.87 min |
| Eluent recycle flow rate: | 650 l/h |
| Eluent make-up (between zones V and I) | 96 l/h |

-continued

| | |
|---|---|
| Fraction 3 injection (between zones II and III) | 35 l/h |
| Fraction 2 injection (between zones III and IV) | 41 l/h |
| Fraction B collection (between zones I and II) Containing 1.29 g/l of purified DHA (C18:4 = 2.1%; C20:5 = 1.0%; C21:5 = 1.9%; C22:5 = 11.2%; C22:6 = 83.1%; others = 0.7%) | 95 l/h |
| Fraction A collection (between zones IV and V) Containing 1.96 g/l of purified EPA (C18:4 = 0.8%; C20:1 = 4.0%; C20:4 = 4.9%; C20:5 = 88.0%; C22:5 = 1.1%; C22:6 = 0.8%; others = 0.4%) | 77 l/h |

Even purer DHA and EPA fractions can be obtained with other starting compositions.

COMPARATIVE EXAMPLE 1

Purification of a mixture of fatty acid ester obtained from fish oil.

The feed was the same as used in Example 3 and was directly injected into a simulated countercurrent chromatography similar to that described in second step in Example 3 but with 4 zones (I to IV) of 2, 3, 3 and 2 columns respectively, with one injection point and two collection points.

The operating flow rates and recovery were as follows:

shift period: 2.87 min

Eluent recycle flowrate: 650 l/h

Eluent make-up (between zones IV and I): 98 l/h

Feed injection (between zones II and III): 76 l/h containing 3.5 g/l of feed

Fraction B Collection (between zones I and II): 95 l/h containing 1.22 g/l of enriched DHA (C16:0=15.5%; C16:4=8.6%; C18:0=6.9%; C18:4=1.7%; C22:5=6.1%; C22:6=47.1%; others=14.1%.

Fraction A collection (between zones III an IV): 79 l/h containing 1.9 g/l of enriched EPA (C16:0=4.1%; C16:4=4.0%; C18:0=2.1%; C18:4=4.9%; C20:1 7.3%; C20:4=6%; C20:5=56%; C22:6=0.7%; others =14.9%).

The two collected fractions have low DHA and EPA concentrations, demonstrating a poor fractionation in comparison with those obtained in the examples presented above.

EXAMPLE 4

This example illustrates the purification of a mixture of fatty acid ester obtained from linseed oil, in order to recover pure esters of alpha-linolenic acid (C18:3, n-3), using a first stage fractionation on a stationary bed followed by a second stage fractionation using a simulated moving bed in which the eluent is supercritical fluid with modulated elution strength.

Linseed oil is subjected to transesterification with ethanol by a conventional method and leads to a mixture of ethyl esters the composition of which is presented in Table 1 above.

Simulated continuous countercurrent moving bed chromatography using silica gel (15–35 μm) as stationary phase and supercritical $CO_2$ as eluent, according to the system schematically illustrated in FIG. 4*a* with 3 zones (I, II, III) and a separator (S) permits fractionation in 2 fractions (SB, SA): 6 columns (12.8 cm diameter, 10 cm length of the packing) are connected in series and in a closed loop with one injection point (IA+B), one eluent make-up (IE), one collection point (SB) and the separation device described herebefore with extract collection point (SA); each zone (I, II, III) is composed of two successive columns.

The operating parameters, flowrates and recovery are as follows in two cases run for performance comparison:

EXAMPLE 4a

Constant pressure 200 bar. Temperature 50° C.

Separator (S): pressure 50 bar. Temperature 50° C.

Shift period: 3.7 min.;

Eluent recycle flowrate (IR): 141 kg/h ($CO_2$);

Eluent make-up-(IE): 52.90 kg/h ($CO_2$);

Injection (IA+B): 4.75 kg/h composed of 0.095 kg/h of oil (Table 1) and 4.655 kg/h ($CO_2$);

Fraction (SB): 57.55 kg/h composed of 0.057 kg/h of oil (C18:3: 99%) and 57.49 kg/h of $CO_2$;

Fraction (SA): 0.098 kg/h composed of 0.038 kg/h of oil (C18:3: 3%) and 0.060 kg/h of $CO_2$.

EXAMPLE 4b

Pressure modulation. Temperature 50° C.

| | |
|---|---|
| Zone I: | 280 bar |
| Zone II: | 250 bar |
| Zone III: | 150 bar |
| Separator (S): | 50 bar |
| Shift period: | 2.6 min |
| Eluent recycle flowrate (IR): | 141 kg/h ($CO_2$) |
| Eluent make-up (IF): | 41.59 kg/h ($CO_2$) |
| Injection (IA + B): | 7.96 kg/h composed of 0.16 kg/h of oil (composition Table 1) and 7.80 kg/h of $CO_2$ |
| Fraction (SB): | 49.4 kg/h composed of 0.095 kg/h of oil (C18:3: 99%) and 49.305 kg/h of $CO_2$ |
| Fraction (SA): | 0.150 kg/h composed of 0.065 kg/h of oil (C18:3: 3%) and 0.085 kg/h of $CO_2$ |

Comparison of performances obtained with and without pressure modulation demonstrates the advantages of such pressure modulation as, for similar equipment, the production of purified fatty acid ester is increased by more than 60% (0.057 kg/h to 0.095 kg/h).

EXAMPLE 5

This example illustrates the purification of a mixture of fatty acid esters obtained from fish oil, in order to recover purified EPA and DHA, utilizing a single stage chromatographic fractionation carried out on a simulated moving bed system utilizing a modulated supercritical fluid as eluent.

Fish oil is subjected to transesterification with ethanol by a conventional method and after molecular distillation leads to a mixture of ethyl esters the composition of which is presented in Table 2b above in weight percent.

Fractionation of this mixture is realized on a simulated countercurrent moving bed chromatography system using bonded octadecyl silica gel (12–45 μm) as stationary phase and supercritical $CO_2$ as eluent according to the system schematically illustrated in FIG. 4*b* with 4 zones (I, II, III, IV) and a separator permitting fractionation in 3 fractions (SA, SB, SC): 8 columns (diameter 8 cm, length of packing: 10 cm connected in series and in a close loop with one injection point (IA+B+C), one eluent make-up (IE), two collection points (SC, SB) and the separation device described herebefore with extract-collection point (SA); each zone (I, II, III, IV) is composed of two successive columns.

The operating parameters and flowrates and recovery are as follows in two cases run for performances comparison:

EXAMPLE 5A

Constant pressure 130 bar. Temperature 50° C. In the separator (S): pressure 50 bar. Temperature 50° C.

Shift period: 1.65 min;

Eluent recycle flowrate (IR): 55 kg/h ($CO_2$);

Eluent make-up (IE): 12.01 kg/h ($CO_2$);

Injection (IA+B+C): 5.41 kg/h composed of 0.054 kg/h of oil (composition table 2b and 5.356 kg/h $CO_2$;

Fraction (SC): 10.280 kg/h composed of 0.013 kg/h of oil (C20:5, n-3=0.6%, C22:6, n-3=87%) and 10.267 kg/h of $CO_2$;

Fraction (SB): 7.09 kg/h composed of 0.034 kg/h of oil (C20:5, n-3=52%, C22:6, n-3=1.5%) and 7.056 kg/h of $CO_2$;

Fraction (SA): 0.047 kg/h composed of 0.007 kg/h of oil (C20:5, n-3=1.2%, C22:6, n-3=0.5%) and 0.040 kg/h of $CO_2$.

EXAMPLE 5b

Pressure modulation. Temperature 50° C.

| Pressures: | |
|---|---|
| Zone I: | 150 bar |
| Zone II: | 135 bar |
| Zone III: | 115 bar |
| Zone IV: | 115 bar |
| Separator (S): | 50 bar |
| Shift period: | 1.45 min |
| Eluent recycle flowrate (SR): | 55 kg/h ($CO_2$) |
| Injection (IA + B + C): | 14.1 kg/h composed of 0.14 kg/h of oil (composition table 2b) and 13.96 kg/h of $CO_2$ |
| Fraction (SC): | 5.2 kg/h composed of 0.033 kg/h of oil (C20:5: n-3 = 0.4%, C22:6, n-3 = 87.5%) and 5.167 kg/h of $CO_2$; |
| Fraction (SB): | 4.0 kg/h composed of 0.081 kg/h of oil (C20:5, n-3 = 56%, C22:6, n-3 = 0.4%) and 3.919 kg/h of $CO_2$ |
| Fraction (SA): | 0.082 kg/h composed of 0.026 kg/h of oil (C20:5, n-3 = 0.9%, C22:6, n-3 = 0.1%) and 0.056 kg/h of $CO_2$. |

Surprisingly, the process leads to a higher concentration of oil in fraction (SB) than in the feed (IA+B+C). In addition, no eluent make-up is necessary since part of the eluent (4.8 kg/h) is used to dilute the feed (IA+B+C) and is not recirculated to Zone I. Therefore, IE is withdrawal of eluent instead of make-up. This is in contrast to Example 5A (constant pressure) where 12 kg $CO_2$/h had to be added.

When comparing the results obtained in Examples 5a and 5b, it is obvious that pressure modulation is very attractive as it leads to a very significant increase in productivity of purified fractions.

Alternatively, for those skilled in the art it will be apparent that instead of using pressure modulation to increase the productivity pressure modulation can be used to produce more highly purified fractions.

In order to obtain high purity fractions of both interesting compounds (C20:5 and C22:6), one could use a feed which has been pre-concentrated using known techniques. Alternatively, it would be possible to use two simulated moving bed systems working in series or yet further a combination of a first step of preparative chromatography using a fluid at supercritical pressure as eluent and leading to feeds concentrated in these two fatty acid esters, followed by a second step utilizing simulated moving bed chromatography equipment.

EXAMPLE 6

This example illustrates the purification of a mixture of fatty acid esters obtained from fish oil, in order to recover purified EPA and DHA.

Feed composition used is similar to Example 5 (see Table 2b).

This fractionation is realized by a combination of preparative supercritical fluid chromatography (PSFC) and simulated countercurrent moving bed chromatography also using supercritical fluid as eluent.

The first step is operated on a 60 mm diameter chromatography column packed with bonded octadecyl silica gel (12–45 μm) as stationary phase with a packing length of 30 cm, and supercritical $CO_2$ as eluent at 50° C., the pressure being 160 bar at the column inlet and 154 bar at column outlet, and the $CO_2$ flowrate 40 kg/h. The cycle duration is 12 min; 12 g of feed are injected per injection (60 g/h). Four fractions are collected after solvent separation by decompression: F1 and F4 are rejected, F2 (EPA rich) and F3 (DHA rich) are subjected to further purification in the second step (simulated moving bed):

The feed and F1 to F4 fractions mass compositions are presented in Table 7.

TABLE 7

| | Feed | F1 | F2 | F3 | F4 |
|---|---|---|---|---|---|
| C14 | 0.3 | 0.8 | 0 | 0 | 0 |
| C16:0 | 9.1 | 25.1 | 0 | 0 | 0 |
| C16:1 | 2.8 | 7.7 | 0 | 0 | 0 |
| C16:4 | 6.0 | 16.6 | 0 | 0 | 0 |
| C18:0 | 4.2 | 11.6 | 0 | 0 | 0 |
| C18:1 | 0.1 | 0.3 | 0 | 0 | 0 |
| C18:2 | 0.6 | 1.7 | 0 | 0 | 0 |
| C18:3 | 0.3 | 0.8 | 0 | 0 | 0 |
| C18:4 | 3.5 | 8.3 | 1.7 | 0 | 0 |
| C20:1 | 4.5 | 11.8 | 0.7 | 0 | 0 |
| C20:4 | 3.7 | 8.3 | 2 | 0.4 | 0 |
| C20:5 | 32.8 | 2.2 | 73.6 | 35.4 | 0 |
| C21:5 | 0.9 | 0.3 | 2 | 0.7 | 0 |
| C22:1 | 0.1 | 0 | 0 | 0.2 | 0.9 |
| C22:5 | 2.7 | 0.3 | 3.3 | 5.3 | 1.7 |
| C22:6 | 20.9 | 0 | 15.1 | 56.3 | 8.8 |
| others | 7.5 | 4.2 | 1.6 | 1.7 | 88.6 |
| Fraction mass/feed mass | 1 | 0.362 | 0.299 | 0.2825 | 0.0565 |

Figure 6:
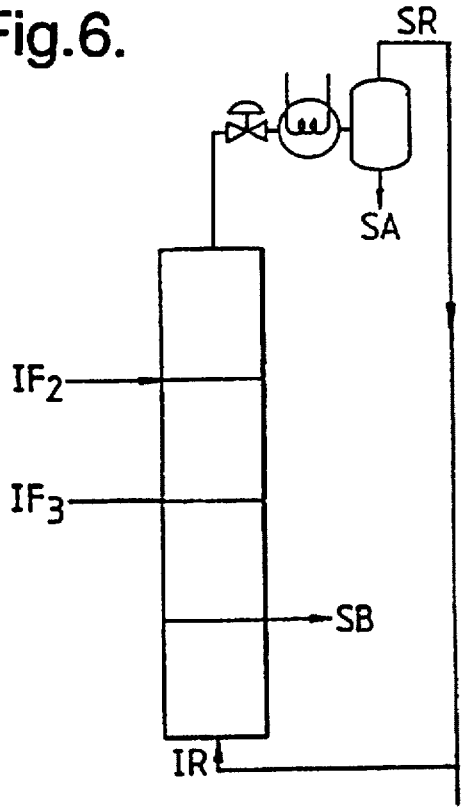
FIG. 6 schematically illustrates the simulated moving bed system utilized in Example 6.

The simulated moving bed apparatus employed has the same characteristics as that used in Example 5 (same size, same stationary phase, 8 columns, 2 columns/zone). However, there are now 2 injection points corresponding to fractions F2 and F3, 1 collecting point SB and the extract collection point SA, as schematically illustrated in FIG. 6.

The operating parameters, flowrates and recovery are as follows in two cases run for performance comparison.

EXAMPLE 6(a)

Constant pressure 130 bar, temperature 50° C.

In the separator: Pressure 50 bar, temperature 50° C.

Shift period: 1.52 min

Eluent recycle flowrate (IR): 55 kg/h

Eluent make up (IE): 4.635 kg/h ($CO_2$)

First injection IF2 (corresponding to fraction F2): 2.97 kg/h containing 0.0305 kg/h of oil (C20:5 0.0225 kg/h, C22:6 0.0046 kg/h)

Second injection IF3 (corresponding to fraction F3): 2.97 kg/h containing 0.0289 kg/h of oil (C20:5 0.0102 kg/h, C22:6 0.0163 kg/h)

Fraction SB: 10.6 kg/h containing 0.0244 kg/h of oil (C22:6 0.0208 kg/h purity>85%)

Fraction SA: 0.075 kg/h containing 0.035 kg/h of oil (C20:5 0.0324 kg/h purity>92%) and 0.040 kg/h of $CO_2$ EXAMPLE 6(b)

Temperature 50° C.

Pressure gradient

Pressure in zone 1:150 bar

Pressure in zone 2:135 bar

Pressure in zone 3:115 bar

Pressure in zone 4:115 bar

In the separator: Pressure 50 bar, temperature 50° C.

Shift period: 1.52 min

Eluent recycle flowrate (IR): 55 kg/h

First injection IF2 (corresponding to fraction F2): 5.5 kg/h of oil (C20:5 0.0417 kg/h, C22:6 0.0085 kg/h)

Second injection IF3 (corresponding to fraction F3): 5.5 kg/h containing 0.0535 kg/h of oil (C20:5 0.0188 kg/h, C22:6 0.0302 kg/h)

Fraction SB: 8.0 kg/h containing 0.0452 kg/h of oil (C22:6 0.0385 kg/h purity>85%)

Fraction SA: 0.127 kg/h containing 0.0647 kg/h of oil (C20:5 0.0603 kg/h purity>93%) and 0.062 kg/h of $CO_2$ As in Example 2b, one part of the recycle eluent SR (2.94 kg/h) is used to dilute the feeds.

In these two examples, the process leads to very high purities for both fractions: EPA is recovered at 99% with a purity of 92% and DHA is recovered at 99% with a purity of 85%.

Comparing production results obtained in Examples 6a and 6b, the pressure modulation system is much more efficient. With the same apparatus and the same purity requirements, productivity using a pressure gradient is increased by 1.85.

EXAMPLE 7

This example illustrates the purification of a mixture of fatty acid esters obtained from fish oil, in order to recover purified EPA and DHA. Feed composition is similar to previous examples (see Table 2 above). This purification is realized by a combination of supercritical fluid fractionation and simulated moving bed chromatography. The process is similar to the process described with reference to FIG. 7.

The operating conditions are as follows in the 4 columns packed with Stainless Steel Pall rings of 10 mm. column C3 having two different jacket sections and column C4 four different jacket sections so that an increasing gradient of temperature is used to cause an internal reflux of extract.

| Columns | Internal diameter mm | Packing height m | Pressure bar | Temperature °C. | Flow-rate $CO_2$ kg/h | Flow-rate feed kg/h |
|---|---|---|---|---|---|---|
| C1 | 75 | 1.4 | 185 | 50 | 50 | 1.00 |
| C2 | 75 | 1.4 | 110 | 60 | 80 | 0.50 |
| C3 | 90 | 2 × 1.4 | 120 | bottom 50<br>head 60 | 120 | 1.36 |
| C4 | 90 | 4 × 1.4 | 135 | 45<br>55<br>60<br>65 | 120 | 0.61 |

The separators B and H are maintained at pressures permitted oil separation and circulation to further steps and $CO_2$ recycle to the classical art. The composition of the four fractions are reported in Table 8.

TABLE 8

| Fatty acid | Feed | F1 | F2 | F3 | F4 |
|---|---|---|---|---|---|
| C14 | 0.3 | 1.2 | — | — | — |
| C16:0 | 9.1 | 28.8 | 0.3 | 0.1 | 0.3 |
| C16:1 | 2.8 | 8.9 | 0.1 | — | 0.1 |
| C16:4 | 6.0 | 19.0 | 0.2 | — | 0.2 |
| C18:0 | 4.2 | 9.7 | 2.0 | 1.1 | 2.0 |
| C18:1 | 0.1 | 0.3 | — | — | — |
| C18:2 | 0.6 | 1.3 | 0.3 | 0.2 | 0.3 |
| C18:3 | 0.3 | 0.7 | 0.1 | 0.1 | 0.1 |
| C18:4 | 3.5 | 8.3 | 1.6 | 0.8 | 1.7 |
| C20:1 | 4.5 | 0.9 | 9.3 | 1.5 | 4.3 |
| C20:4 | 3.7 | 0.7 | 7.7 | 1.2 | 3.6 |
| C20:5 | 32.8 | 6.6 | 68.2 | 10.8 | 31.6 |
| C21:5 | 0.9 | 0.1 | 1.3 | 1.4 | 1.1 |
| C22:1 | 0.1 | — | — | 0.4 | 0.1 |
| C22:5 | 2.7 | 0.3 | 1.0 | 8.9 | 2.9 |
| C22:6 | 20.9 | 1.9 | 7.7 | 69.2 | 22.1 |
| Others | 7.5 | 11.3 | 0.2 | 4.3 | 29.4 |
| Fraction mass/feed mass | 1 | 0.31 | 0.37 | 0.22 | 0.10 |

Figure 8:
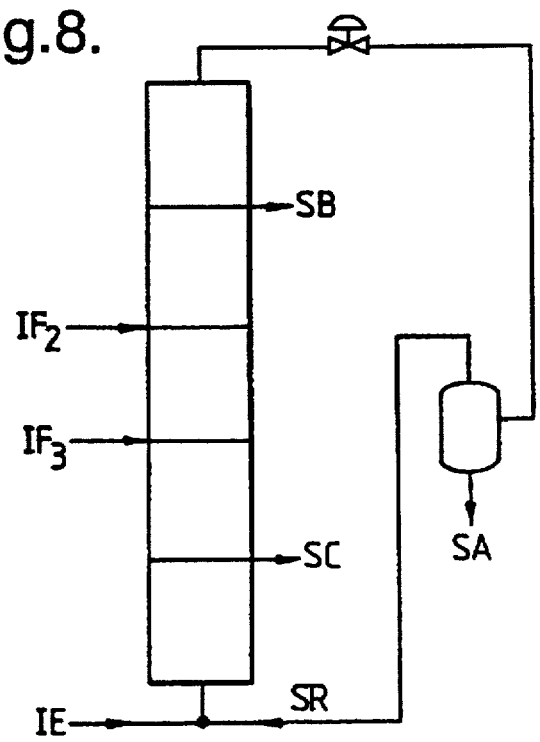
FIG. 8 schematically illustrates the simulated moving bed system utilized in Example 7.

The simulated moving bed apparatus has the same general characteristics as described previously (e.g. same columns, two columns/zone, same stationary phase). However, as shown in FIG. 8, there are two injections points corresponding to fractions $F_2$ and $F_3$, two collecting points SB, CF and the extract collection point SA.

The operating parameters, flowrates and recovery are as follows in two cases run for performance comparison.

EXAMPLE 7a

Constant pressure 130 bar, temperature 50° C. In the separator: pressure 50 bar, temperature 50° C.

Shift period: 2.23 min

Eluent Recycle flowrate (IR) 55 kg/h ($CO_2$)

Eluent make up: 12.2 kg.h ($CO_2$)

First injection IF2 (corresponding to fraction F2) 3.24 kg/h composed of 0.032 kg/h of fraction F2 (composition in Table 8) and 3.21 kg/h of $CO_2$ Second injection IF3 (corresponding to fraction F3) 1.93 kg/h composed of 0.0193 kg/h of fraction F3 (composition in Table 8) and 1.91 kg/h of $CO_2$ Fraction SA 0.01 kg/h composed of 0.017 kg/h of oil and 0.008 kg/h of $CO_2$ Fraction SB 6.47 kg/h composed of 0.031 kg of oil (C20:5 purity: 77.8%, C22:6=1%) and 6.44 kg/h Of $CO_2$ Fraction SC 10.92 kg/h composed of 0.019 kg/h of oil (C22:6 purity=84%, C20:5<1%) and 10.9 kg/h of $CO_2$ EXAMPLE 7b Pressure gradient Pressure in zone 1: 150 bar Pressure in zone 2: 135 bar Pressure in zone 3: 115 bar Pressure in zone 4: 115 bar Pressure in zone 5: 115 bar Temperature: 50° C. In the separator: pressure 50 bar, Temperature 50° C.

Shift period: 1.60 min

Eluent Recycle flowrate (IR) 55 kg/h ($CO_2$)

First injection IF2 (corresponding to fraction F2) 6.40 kg/h composed of 0.064 kg/h of fraction F2 and 6.34 kg/h of $CO_2$ Second injection IF3 (corresponding to fraction F3) 3.81 kg/h composed of 0.038 kg/h of fraction F3 and 3.77 kg/h of $CO_2$ Fraction SA 0.015 kg/h composed of 0.01 kg/h of oil and 0.01 kg/h of $CO_2$ Fraction SB 2.03 kg/h composed of 0.06 kg of oil (C20:5 purity=78.5%, C22:6=0.5%) and 1.97 kg/h of $CO_2$ Fraction SC 4.51 kg/h composed of 0.037 kg/h of oil (C22:6 purity =84%, C20:5<1%) and 4.47 kg/h of $CO_2$ As in Example 5b and 6 one part of the recycle eluent SR is used to dilute the feeds (3.67 kg/h of $CO_2$).

In these two examples, both EPA and DHA are recovered at 99%. The purities are slightly lower than in Example 6 (>77% for EPA and >84% for DHA) because the feeds compositions in EPA and DHA obtained by supercritical fluid fractionation (Example 7) are lower than the ones obtained by supercritical fluid chromatography (Example 6).

Comparing the results from Example 7a and Example 7b, we see again that the pressure modulation system increases dramatically the productivity with the same apparatus and the same purity requirements (the productivity using a pressure gradient is increased by 1.97).

We claim:

1. A process for recovering one or more purified polyunsaturated fatty acids (PUFA) or polyunsaturated fatty acid mixtures from a feed composition comprising said PUFA or PUFAs, which process comprises the steps of: either (i) treating said composition by means either of (a) stationary bed chromatography or (b) multistage countercurrent column fractionation in which the solvent is a fluid at supercritical pressure, and recovering one or more PUFA-enriched fractions, and (ii) subjecting said PUFA-enriched fraction or fractions recovered in step (i) to further fractionation by means of simulated continuous countercurrent moving bed chromatography and recovering one or more fractions containing purified PUFA or PUFA mixture, or (iii) subjecting a feed composition comprising said PUFA or PUFAs to fractionation by means of simulated continuous countercurrent moving bed chromatography in which there is used as the eluent a fluid at a supercritical pressure, and recovering one or more fractions containing purified PUFA or PUFA mixture.

2. A process according to claim 1, wherein, in step (i), the eluent used in said stationary bed chromatography is a fluid at supercritical pressure.

3. A process according to claim 1, wherein, in step (i), the multistage countercurrent column fractionation is carried out in two or more multistage countercurrent columns.

4. A process according to claim 1, wherein, in step (i), one or more PUFA-depleted fractions are subjected to one or more of the following treatments: (A) it is discarded, (B) it is subjected to evaporation for recovery of eluent or solvent, (C) it is recycled, and (D) it is returned to the feed composition.

5. A process according to claim 1, wherein two or more fractions recovered in step (i) are introduced into step (ii).

6. A process according to claim 5, wherein said two or more fractions are introduced at separate injection points into the simulated continuous countercurrent moving bed chromatographic system.

7. A process according to claim 1, wherein a fluid at supercritical pressure is used as the eluent in step (ii).

8. A process according to claim 1, wherein, in step (ii), one or more PUFA-depleted fractions resulting from the simulated continuous countercurrent moving bed chromatography are subjected to one or more of the following treatments: (A) it is discarded, (B) it is recycled to step (i), and (C) it is recycled through step (ii).

9. A process according to claim 1, wherein, in one or more of steps (i)(a) and (ii), there is used as the stationary phase in the chromatographic system C18 bonded silica gel.

10. A process according to claim 1, for recovering one or more purified PUFAs or PUFA mixtures from a feed composition comprising said PUFA or PUFAs, which process comprises the step (iii).

11. A process according to claim 1, wherein said fluid is $CO_2$.

12. A process according to any one of claims 1–3, wherein said feed composition is a composition of animal or vegetable origin, which optionally has been subjected to one or more pretreatments to achieve one or more of the following effects: (A) enhancement of the PUFA concentration therein and (B) removal of contaminants.

13. A process according to claim 12, wherein said composition of animal origin is a marine oil.

14. A process according to claim 13, wherein said marine oil comprises one or more members of the group consisting of eicosapentaenoic acid (EPA) and docosahexaenoic acid (DHA), and wherein said process is carried out so as to recover purified EPA, purified DHA, or both.

* * * * *

UNITED STATES PATENT AND TRADEMARK OFFICE

CERTIFICATE OF CORRECTION

PATENT NO. : 5,719,302

DATED : February 17, 1998

INVENTOR(S) : Perrut et al.

It is certified that error appears in the above-indentified patent and that said Letters Patent is hereby corrected as shown below:

COLUMN 1:

Line 40, "these." should read --these--.

COLUMN 3:

Line 43, "D-" should read --D.--;
Line 44, "ethyligues" should read --ethyliques--;
Line 46, "2cmc" should read --2eme--; and
Line 50, "no" should read --No--.

COLUMN 5:

Line 20, "envelop" should read --envelope--.

COLUMN 7:

Line 63, "chromatogrpahic" should read --chromatographic--.

COLUMN 8:

Line 29, "stge" should read --stage--; and
Line 47, "Thus, is" should read --Thus, it is--.

UNITED STATES PATENT AND TRADEMARK OFFICE

CERTIFICATE OF CORRECTION

PATENT NO. : 5,719,302

DATED : February 17, 1998

INVENTOR(S) : Perrut et al.

It is certified that error appears in the above-indentified patent and that said Letters Patent is hereby corrected as shown below:

COLUMN 13:

Line 54, "fluidat" should read --fluid at--; and
Line 60, "Fr" should read --FR--.

COLUMN 14:

Line 38, "light or" should read --lighter--; and
Line 49, "non polar" should read --nonpolar--.

COLUMN 15:

Line 40, "$C_L$" should read --$C_\ell$--;
Line 42, "$(W_{L-1})$, $(W''_{L-1})$," should read --$(W_{\ell-1})$, $(W''_{\ell-1})$,--; and
Line 43, "$(W'''_{L-1})$" should read --$(W'''_{\ell-1})$--.

COLUMN 17:

Line 32, "acids" should read --acid--.

UNITED STATES PATENT AND TRADEMARK OFFICE

CERTIFICATE OF CORRECTION

PATENT NO. : 5,719,302

DATED : February 17, 1998

INVENTOR(S) : Perrut et al.

It is certified that error appears in the above-indentified patent and that said Letters Patent is hereby corrected as shown below:

COLUMN 21:

Line 25, "second" should read --the second--; and
Line 41, "an" should read --and--.

COLUMN 23:

Line 4, "close" should read --closed--; and
Line 21, "2b" should read --2b)--.

Signed and Sealed this

Twelfth Day of January, 1999

*Attest:*

*Attesting Officer*

*Acting Commissioner of Patents and Trademarks*